US010854040B1

(12) United States Patent
Däumling et al.

(10) Patent No.: US 10,854,040 B1
(45) Date of Patent: Dec. 1, 2020

(54) GAMING SYSTEM AND METHOD PROVIDING EXPANDING SYMBOLS

(71) Applicant: ADP GAUSELMANN GMBH, Espelkamp (DE)

(72) Inventors: Uwe Däumling, Ibbenbüren (DE); Uwe Horn, Kiel (DE)

(73) Assignee: ADP GAUSELMANN GMBH, Espelkamp (DE)

( * ) Notice: Subject to any disclaimer, the term of this patent is extended or adjusted under 35 U.S.C. 154(b) by 0 days.

(21) Appl. No.: 16/516,144

(22) Filed: Jul. 18, 2019

(51) Int. Cl.
*G07F 17/32* (2006.01)
*G07F 17/34* (2006.01)

(52) U.S. Cl.
CPC ..... *G07F 17/3213* (2013.01); *G07F 17/3225* (2013.01); *G07F 17/34* (2013.01)

(58) Field of Classification Search
CPC ..... G07F 17/32
See application file for complete search history.

(56) References Cited

U.S. PATENT DOCUMENTS

| | | | |
|---|---|---|---|
| 5,833,537 | A | 11/1998 | Barrie |
| 5,980,384 | A | 11/1999 | Barrie |
| 6,159,095 | A | 12/2000 | Frohm et al. |
| 6,186,894 | B1 | 2/2001 | Mayeroff |
| 6,251,013 | B1 | 6/2001 | Bennett |
| 6,290,600 | B1 | 9/2001 | Glasson |
| 6,311,976 | B1 | 11/2001 | Yoseloff et al. |
| 6,319,124 | B1 | 11/2001 | Baerlocher et al. |
| 6,394,902 | B1 | 5/2002 | Glavich et al. |
| 6,517,432 | B1 | 2/2003 | Jaffe |
| 6,558,254 | B2 | 5/2003 | Baerlocher et al. |
| 6,561,900 | B1 | 5/2003 | Baerlocher et al. |
| 6,632,140 | B2 | 10/2003 | Berman et al. |
| 6,692,356 | B2 | 2/2004 | Baerlocher et al. |
| 6,780,109 | B2 | 8/2004 | Kaminkow |
| 6,866,583 | B2 | 3/2005 | Glavich et al. |
| 6,896,617 | B2 | 5/2005 | Daly |
| 6,921,335 | B2 | 7/2005 | Rodgers et al. |
| 7,052,395 | B2 | 5/2006 | Glavich et al. |
| 7,137,888 | B2 | 11/2006 | Glavich et al. |
| 7,384,334 | B2 | 6/2008 | Glavich et al. |
| 7,393,277 | B2 | 7/2008 | Jackson |
| 7,396,282 | B2 | 7/2008 | Gauselmann |
| 7,399,225 | B2 | 7/2008 | Kaminkow |
| 7,736,223 | B2 | 6/2010 | Pace |

(Continued)

FOREIGN PATENT DOCUMENTS

| | | |
|---|---|---|
| AU | 2014903132 | 8/2014 |
| AU | 2015210489 A1 | 2/2016 |

(Continued)

OTHER PUBLICATIONS

Aristocrat Technologies Australia Pty Ltd., "Lightning Link", Retrieved from the Internet on Oct. 25, 2018: http://www.aristocrat-us.com/lightning-link, p. 1.

*Primary Examiner* — Omkar A Deodhar
(74) *Attorney, Agent, or Firm* — Resolute Legal PLLC

(57) ABSTRACT

A gaming system and method provide a game that can increase the quantity of a displayed predetermined symbol based on a suitable game event. In some implementations, the suitable game event can be a non-winning event associated with a displayed predetermined symbol. Increasing the quantity of a displayed predetermined symbol provides additional ways for a player to obtain winning symbol combinations and awards.

20 Claims, 10 Drawing Sheets

(56) References Cited

U.S. PATENT DOCUMENTS

| | | | |
|---|---|---|---|
| 7,749,071 | B2 | 7/2010 | Marks et al. |
| 7,794,320 | B2 | 9/2010 | Baerlocher et al. |
| 7,846,018 | B2 | 12/2010 | Baerlocher |
| 7,922,573 | B2 | 4/2011 | Baerlocher et al. |
| 7,927,204 | B2 | 4/2011 | DeBrabander, Jr. et al. |
| 7,959,504 | B2 | 6/2011 | Baumgartner et al. |
| 8,002,626 | B2 | 8/2011 | Englman |
| 8,137,180 | B2 | 3/2012 | Thomas et al. |
| 8,152,627 | B2 | 4/2012 | Berman et al. |
| 8,162,741 | B2 | 4/2012 | Wadleigh et al. |
| 8,197,330 | B2 | 6/2012 | Englman et al. |
| 8,231,460 | B2 | 7/2012 | Gauselmann |
| 8,272,944 | B2 | 9/2012 | Englman et al. |
| 8,337,300 | B2 | 12/2012 | Bowers et al. |
| 8,357,041 | B1 | 1/2013 | Saunders |
| 8,382,571 | B2 | 2/2013 | Marks et al. |
| 8,469,793 | B2 | 6/2013 | Visser |
| 8,491,375 | B2 | 7/2013 | Low |
| 8,506,380 | B2 | 8/2013 | Hughes et al. |
| 8,517,814 | B2 | 8/2013 | Visser |
| 8,574,061 | B2 | 11/2013 | Marks et al. |
| 8,585,485 | B2 | 11/2013 | Guinn |
| 8,608,543 | B2 | 12/2013 | Cuddy et al. |
| 8,622,809 | B1 | 1/2014 | Arora et al. |
| 8,814,658 | B2 | 8/2014 | Marks et al. |
| 8,840,457 | B1 | 9/2014 | Basallo et al. |
| 9,011,233 | B2 | 4/2015 | Ryan |
| 9,129,492 | B2 | 9/2015 | Marks et al. |
| 9,153,090 | B2 | 10/2015 | Pacey et al. |
| 9,177,448 | B2 | 11/2015 | Caputo et al. |
| 9,214,067 | B2 | 12/2015 | Basallo et al. |
| 9,218,705 | B2 | 12/2015 | Taylor |
| 9,230,409 | B2 | 1/2016 | Pawloski |
| 9,449,470 | B2 | 9/2016 | Baerlocher et al. |
| 9,704,342 | B2 | 7/2017 | Aoki et al. |
| 9,710,998 | B2 | 7/2017 | Nelson et al. |
| 9,786,116 | B2 | 10/2017 | Saunders |
| 9,805,542 | B2 | 10/2017 | Rodgers et al. |
| 9,805,553 | B2 | 10/2017 | Zielinski et al. |
| 9,852,574 | B2 | 12/2017 | Zoltewicz et al. |
| 9,928,691 | B2 | 3/2018 | Olive |
| 10,037,651 | B2 | 7/2018 | You et al. |
| 2001/0054794 | A1 | 12/2001 | Cole et al. |
| 2002/0043759 | A1 | 4/2002 | Vancura |
| 2002/0045474 | A1 | 4/2002 | Singer et al. |
| 2003/0022712 | A1 | 1/2003 | Locke |
| 2004/0009808 | A1 | 1/2004 | Gauselmann |
| 2004/0043809 | A1 | 3/2004 | Gomez et al. |
| 2004/0048646 | A1 | 3/2004 | Visocnik |
| 2004/0053673 | A1 | 3/2004 | Mishra |
| 2004/0204228 | A1 | 10/2004 | Walker et al. |
| 2005/0130737 | A1 | 6/2005 | Englman et al. |
| 2005/0159208 | A1 | 7/2005 | Pacey |
| 2006/0058097 | A1 | 3/2006 | Berman et al. |
| 2006/0068892 | A1 | 3/2006 | Gomez et al. |
| 2006/0154717 | A1 | 7/2006 | Jackson |
| 2006/0189377 | A1 | 8/2006 | Gomez et al. |
| 2008/0045302 | A1 | 2/2008 | Low |
| 2008/0248865 | A1 | 10/2008 | Tedesco et al. |
| 2009/0131150 | A1 | 5/2009 | Iverson et al. |
| 2009/0137311 | A1 | 5/2009 | Iverson et al. |
| 2009/0221353 | A1 | 9/2009 | Joung |
| 2010/0029381 | A1 | 2/2010 | Vancura |
| 2010/0120489 | A1 | 5/2010 | Meyer |
| 2010/0190542 | A1 | 7/2010 | Mizue |
| 2010/0197377 | A1 | 8/2010 | Aoki et al. |
| 2010/0304833 | A1 | 12/2010 | Berman |
| 2011/0003627 | A1 | 1/2011 | Nicely et al. |
| 2011/0034234 | A1 | 2/2011 | Berman et al. |
| 2011/0111829 | A1 | 5/2011 | Joung |
| 2011/0117989 | A1 | 5/2011 | Kennedy et al. |
| 2011/0136565 | A1 | 6/2011 | Low |
| 2011/0230251 | A1 | 9/2011 | Nicely et al. |
| 2012/0231868 | A1 | 9/2012 | Guinn |
| 2012/0295688 | A1 | 11/2012 | Watkins et al. |
| 2013/0143639 | A1 | 6/2013 | Nakamura |
| 2014/0018146 | A1 | 1/2014 | Zielinski et al. |
| 2014/0039693 | A1 | 2/2014 | Lanning et al. |
| 2014/0087821 | A1 | 3/2014 | Zoltewicz et al. |
| 2014/0087860 | A1 | 3/2014 | Basallo et al. |
| 2014/0087861 | A1 | 3/2014 | Basallo et al. |
| 2014/0274294 | A1 | 9/2014 | Baerlocher et al. |
| 2014/0309010 | A1 | 10/2014 | Pawloski |
| 2014/0357342 | A1 | 12/2014 | Elias |
| 2015/0080096 | A1 | 3/2015 | Saunders et al. |
| 2015/0141114 | A1 | 5/2015 | Davis et al. |
| 2015/0248810 | A1 | 9/2015 | Wortmann et al. |
| 2015/0310699 | A1 | 10/2015 | Meyer |
| 2015/0348374 | A1 | 12/2015 | Dupuis |
| 2016/0042597 | A1 | 2/2016 | Olive |
| 2016/0078711 | A1 | 3/2016 | Rucker |
| 2016/0086429 | A1 | 3/2016 | Inamura et al. |
| 2016/0253873 | A1 | 9/2016 | Olive |
| 2016/0335842 | A1 | 11/2016 | Zoble et al. |
| 2017/0032610 | A1 | 2/2017 | Loz et al. |
| 2017/0092067 | A1 | 3/2017 | Batsiokis |
| 2017/0124809 | A1 | 5/2017 | Elias |
| 2017/0154498 | A1 | 6/2017 | Olive |
| 2018/0082535 | A1 | 3/2018 | Filipour et al. |
| 2018/0082546 | A1 | 3/2018 | Mariscal et al. |
| 2018/0122183 | A1 | 5/2018 | Wortmann |
| 2018/0130298 | A1 | 5/2018 | Koshorek |
| 2018/0218572 | A1 | 8/2018 | Caputo |
| 2018/0225914 | A1 | 8/2018 | Heenan |
| 2018/0261045 | A1 | 9/2018 | Takahara et al. |
| 2018/0268655 | A1 | 9/2018 | Olive |
| 2018/0268657 | A1 | 9/2018 | Kroon |
| 2018/0286183 | A1 | 10/2018 | Davis et al. |

FOREIGN PATENT DOCUMENTS

| | | | |
|---|---|---|---|
| AU | 2016900462 | | 2/2016 |
| AU | 2016100230 | A4 | 3/2016 |
| AU | 2016202727 | A1 | 5/2016 |
| AU | 2016101967 | A4 | 12/2016 |
| AU | 2017200840 | A1 | 3/2017 |
| AU | 2017204560 | A1 | 7/2017 |
| AU | 2017101097 | A4 | 9/2017 |
| AU | 2017101098 | A4 | 9/2017 |
| AU | 2017101629 | A4 | 12/2017 |
| AU | 2017101730 | A4 | 1/2018 |
| AU | 2017101731 | A4 | 1/2018 |
| AU | 2018278882 | A1 | 1/2019 |
| AU | 201900719 | A1 | 2/2019 |

GAMING SYSTEM AND METHOD PROVIDING EXPANDING SYMBOLS

FIELD

The present disclosure relates to gaming systems.

BACKGROUND

Gaming systems accept wagers from players in exchange for opportunities to win awards or prizes. Current gaming systems combine various specialized computing technologies to provide systems adapted to gain the attention of players and to keep them engaged with the gaming systems. To retain players' interest, gaming systems that offer new and unconventional functionality are needed.

SUMMARY

The present disclosure is directed to systems and processes for gaming. A gaming system consistent with implementations disclosed herein provides a game that randomly determines symbols and displays such symbols to players using a display device. The gaming system evaluates the displayed symbols to determine whether they correspond to predetermined awards.

In accordance with aspects of the present disclosure, a gaming system and a related method provide a game that can increase the quantity of a displayed predetermined symbol based on a suitable game event. In some implementations, the suitable game event can be a non-winning event associated with a displayed predetermined symbol. Other game events can be used. In some implementations, the gaming system may increase a displayed quantity of a predetermined symbol where an initially displayed predetermined symbol did not result in an award. For example, where the displayed predetermined symbol did not form part of a winning symbol combination, the gaming system may generate and display additional predetermined symbols. The gaming system may generate and display the additional predetermined symbols in symbol display areas of a column of symbol display areas associated with the initially displayed predetermined symbol. The gaming system may replace other displayed symbols in the column with the additional predetermined symbols. The gaming system may evaluate the initially displayed predetermined symbol, the additional predetermined symbols, and any other remaining displayed symbols for winning symbol combinations. The gaming system may provide one or more awards based on the winning symbols or winning symbol combinations.

In some implementations, the gaming system and the related method provide a game that can increase the quantity of a displayed predetermined symbol based on a game event, where the predetermined symbol is an initially displayed Wild symbol. A Wild symbol is a symbol that can substitute for other symbols or take on the properties of other symbols. For example, if a displayed Wild symbol was adjacent to a Cherry symbol, a gaming system may evaluate the Wild symbol as a Cherry symbol for purposes of determining a winning symbol combination. In some implementations, the gaming system may evaluate the Wild symbol as one or more other adjacent symbols.

In some implementations, the gaming system includes a slot machine game with a plurality of reels. In some implementations, the gaming system may generate and display additional Wild symbols on one or more of the plurality of reels where initially displayed Wild symbols did not result in an award. For example, where an initial displayed Wild symbol did not form part of a winning symbol combination (of one or more symbols), the gaming system may determine and display additional Wild symbols. In some implementations, the gaming system may determine and display the additional Wild symbols in other symbol display areas of the reel that displayed the initial Wild symbol. The gaming system may replace other displayed symbols on the reel with the additional Wild symbols. The gaming system may evaluate the initial Wild symbol, the additional Wild symbols, and any other remaining displayed symbols for winning symbol combinations. While the predetermined symbol is described as a Wild symbol, it should be appreciated that in various implementations, the predetermined symbol can be any suitable symbol that the gaming system can select before or during a play of the game.

In some implementations, the gaming system includes symbol display areas associated with video-based slot machine reels. For example, the gaming system may include a three-reel slot machine game, where the reels are associated with symbol display areas. In some implementations, each reel may be associated with three symbol display areas. It should be appreciated that in various implementations, the quantity of reels can be increased or decreased and the quantity of symbol display areas (or visible reel stop positions) can vary. For example, in some implementations, the quantity of reels can be 3, 4, 6, or some other suitable quantity of reels. In some implementations the quantity of symbol display areas of the reels can vary. In some implementations, the quantity of symbol display areas can be 2, 3, 4, 5, 6, or some other suitable quantity of symbol display areas. The gaming system may further include symbol sets associated with the reels, where the symbol sets provide symbols for the reels. In some implementations, each reel can be associated with a symbol set. Further, the gaming machine may include pay lines corresponding to various combinations of symbol display areas. For example, the pay lines may cross the symbol display areas horizontally, vertically, and diagonally. One or more of the pay lines can be activated for a play of a game. For example, selecting a minimum wager amount may activate one pay line, selecting additional wager amounts may activate additional pay lines, and selecting a maximum wager amount may activate all pay lines.

For a play of a game, the gaming system may randomly determine (e.g., generate, select, etc.) a plurality of symbols from the associated symbol sets for the symbol display areas of the reels. The gaming system may display the plurality of determined symbols in symbol display areas of the reels. The gaming system may evaluate the determined plurality of symbols to identify winning symbols or winning symbol combinations. In some implementations, the gaming system may determine awards to provide to a player based winning symbol combinations appearing along wagered pay lines. In some implementations, the gaming system may use other methods to determine winning symbol combinations in addition to or without pay lines. For example, the gaming system may evaluate the displayed symbols for scatter pay symbols, or based on ways-pays, etc. The gaming system may determine one or more awards based on identified winning symbols or winning symbol combinations.

In some implementations, the gaming system may also evaluate the displayed symbols for Wild symbols. If the gaming system determines that Wild symbols are displayed on the reels, the gaming system may determine whether the displayed Wild symbols (e.g., initially displayed Wild symbols) were associated with an award. If the initially displayed Wild symbols were associated with an award, the gaming system may update a player's credit balance based on the determined one or more awards and also determine if a bonus game is triggered. If the gaming system determines that a bonus game is triggered, the gaming system may execute the bonus game. At the conclusion of the bonus game the gaming system may start another play of the game or enable the player to cash out.

On the other hand, in some implementations, if at least one displayed Wild symbol was not associated with an award, the gaming system may determine one or more additional Wild symbols to display in symbol display areas of the reels. For example, in some implementations, the gaming system may determine two additional Wild symbols to display on a reel with the initially displayed Wild symbol. In some implementations, the gaming system may display the determined two additional Wild symbols on the reel, either by replacing the non-Wild symbols on the reel or obscuring the non-Wild symbols on the reel with the two additional Wild symbols.

In some implementations, the gaming system may randomly determine a plurality of replacement symbols for one or more of the symbol display areas of the reels that do not include Wild symbols. The gaming system may display the determined plurality of replacement symbols in one or more of the symbol display areas of the reels that do not include Wild symbols. The gaming system may the displayed symbols (e.g., the initially displayed Wild symbols, the additional displayed Wild symbols, displayed plurality of replacement symbols, and/or any other remaining displayed symbols) to identify winning symbols or winning symbol combinations. The gaming system may determine one or more awards based on the identified winning symbols or winning symbol combinations.

In some implementations, the gaming system may determine if a bonus game is triggered. If the gaming system determines that a bonus game is triggered, the gaming system may execute the bonus game. At the conclusion of the bonus game the gaming system may start another play of the game or enable the player to cash out.

It should be appreciated that by increasing a quantity of a predetermined symbol (such as a Wild symbol), the gaming system and method provides additional opportunities for a player to obtain winning symbol combinations and provide a player with new ways to obtain awards.

As described above and set forth in greater detail below, gaming systems in accordance with aspects of the present disclosure provide a specialized computing device integrating non-generic hardware and software that improve upon the existing technology of human-computer interfaces by providing unconventional functions, operations, and symbol sets for generating interactive displays and outputs. The features of the gaming system provide a practical implementation that improves the operation of the gaming systems for their specialized purpose of providing entertainment by reducing player disappointment with game outcomes, by enhancing player enjoyment, and by increasing player engagement.

DETAILED DESCRIPTION

Figure 1:
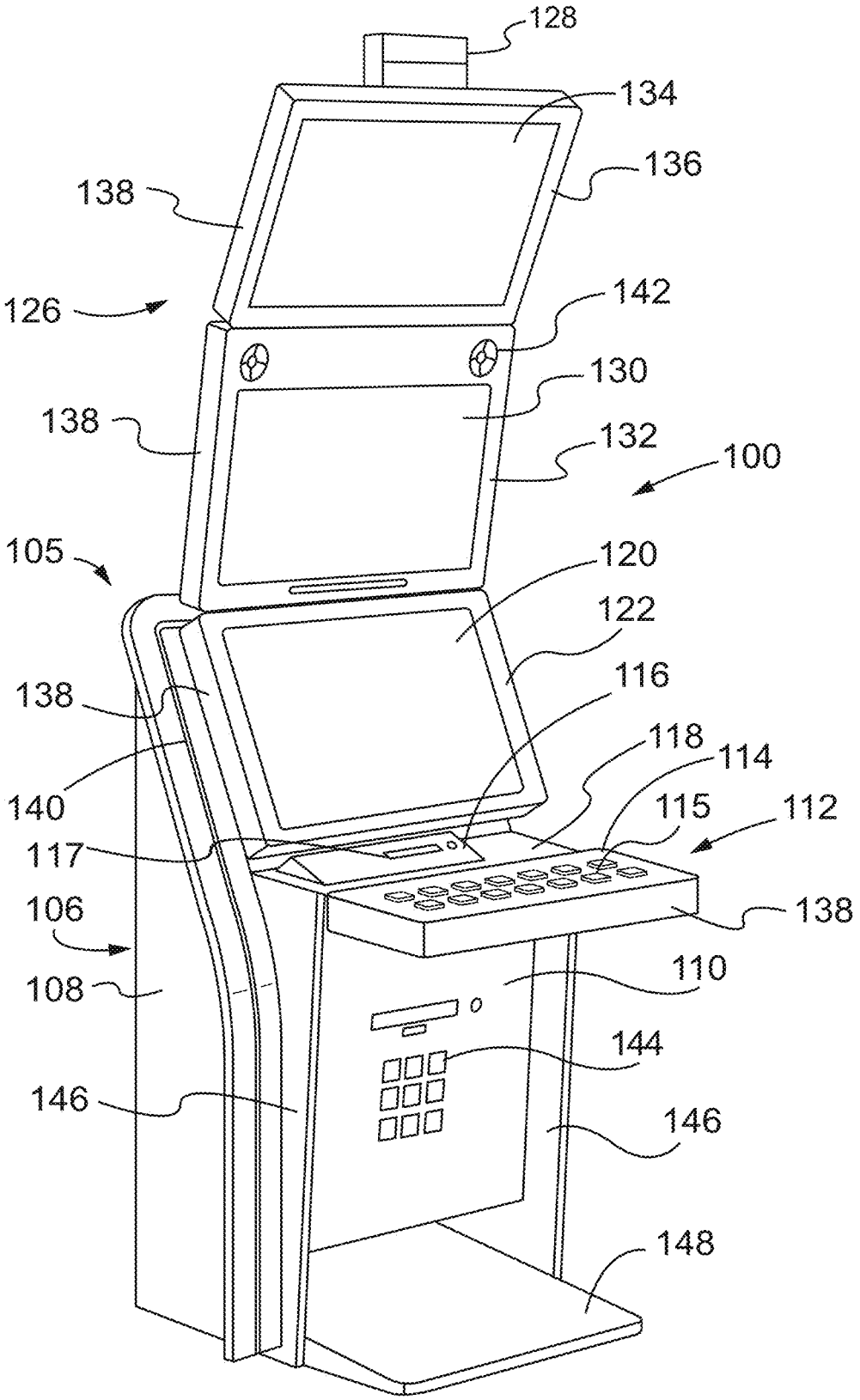
FIG. 1 shows a perspective view illustrating an example gaming system in accordance with aspects of the present disclosure.

The present disclosure provides systems and processes for gaming and amusement devices. In accordance with aspects of the present disclosure, a gaming system and a related method provide a game that can increase the quantity of a displayed predetermined symbol based on a suitable game event. In some implementations, the suitable game event can be a non-winning event associated with a displayed predetermined symbol.

A system of one or more computers can be configured to perform particular operations or actions by virtue of having software, firmware, hardware, or a combination thereof installed on the system that in operation causes or cause the system to perform the actions. One or more computer programs can be configured to perform particular operations or actions by virtue of including instructions that, when executed by data processing apparatus, cause the apparatus to perform the actions. One general aspect includes a method of operating a gaming system including: establishing a credit balance based on a first value received by a value acceptor. The method of operating also includes receiving, from a player input device, a wager for a play of a game using the credit balance. The method of operating also includes determining, with a random number generator, a plurality of symbols for a plurality of symbol display areas. The method of operating also includes displaying, on a display device, the determined plurality of symbols in the plurality of symbol display areas. The method of operating also includes determining that plurality of symbols includes a predetermined symbol and that the predetermined symbol does not result in an award. The method of operating also includes determining one or more additional predetermined symbols. The method of operating also includes displaying, on the display device, the determined one or more additional predetermined symbols, where the displayed additional predetermined symbols replaces at least some of the displayed plurality of symbols. The method of operating also includes determining one or more winning symbol combinations based on the additional predetermined symbols. The method of operating also includes determining one or more awards corresponding to the one or more winning symbol combinations; and issuing a second value from a value dispenser based on the one or more awards upon receipt of a cash out request. Other embodiments of this aspect include corresponding computer systems, apparatus, and computer programs recorded on one or more non-transitory computer-readable storage devices, each configured to perform the actions of the methods.

Implementations may include one or more of the following features. The method where the predetermined symbol is a wild symbol. The method where the predetermined symbol is randomly selected from one or more symbol sets used to determine the plurality of symbols. The method where the determined one or more additional predetermined symbols further includes determining a quantity of predetermined symbols based on a value of the wager. The method where the determined one or more additional predetermined symbols further includes determining a quantity of predetermined symbols based on a quantity of symbol display areas that are in a column of symbol display areas that displays the predetermined symbol. The method where the predetermined symbol is displayed on a reel and the determined one or more additional predetermined symbols further includes determining one additional predetermined symbol for each symbol display area of the reel. The method including determining, with the random number generator, a plurality of replacement symbols for the plurality of symbol display areas that do not include the predetermined symbol or the one or more additional predetermined symbols. The method where the determining of one or more winning symbol combinations further includes determining one or more winning symbol combinations based on the additional predetermined symbols and the plurality of replacement symbols. The method further including determining one or more winning symbol combinations based on the determined plurality of symbols. Implementations of the described techniques may include hardware, a method or process, or computer software on a computer-accessible medium.

Gaming System Platform

The features and advantages of the systems and methods described herein may be provided to a player via a gaming system that includes various structures and components for allowing player interaction with the gaming system. While some examples of gaming systems are described in detail herein, it is understood that the features, objects, and advantages of such gaming systems may be implemented in one or more alternative implementations consistent with the present disclosure.

FIG. 1 shows a perspective view illustrating an example of gaming system 100 in accordance with aspects of the present disclosure. The gaming system 100 may be referred to as a slot machine and, as illustrated, includes a cabinet 105 (e.g., a housing) constructed so that a player can operate and play the gaming system 100 while standing or sitting. The cabinet 105 can include a lower cabinet body portion 106, which includes a pair of cabinet side panels 108 (one of which is visible in the perspective view of FIG. 1 and another that is partially visible in FIG. 1), a front panel 110, and a rear panel (not shown). Additionally, a base panel (not shown) and a top panel surface (not shown) may support a first game display device 120 and the player interaction area 112. The cabinet panels 105, 106, 108, 110 (as well as the base panel and the top panel surface) may be interconnected to form the cabinet 105, which encloses and houses components of the gaming system 100. The cabinet 105 may function to securely protect a local game controller and technology components, and to provide support for game display(s) and player input and output systems of the gaming system 100, such as described herein below.

While the example cabinet 105 is depicted as having a particular shape, structure, and organization, it should be appreciated that a wide variety of cabinet enclosure sizes, shapes, and designs are possible for the gaming system 100. For example, the cabinet panels 105, 106, 108, 110 (as well as the base panel and the top panel surface) may be combined into fewer elements or divided into additional elements. Additionally, the positions of the displays (e.g., first display device 120) and input and output devices can be rearranged with respect to one another. In some implementations, the gaming system 100 may include more or fewer components than described herein.

A player can interact with the gaming system 100 in various ways to direct wagering and game activities. The cabinet 105 may include player input systems and output systems generally designated as the player interaction area 112. In some implementations, the player interaction area 112 can be located on the front top side of cabinet 105 and, as shown, on a panel structure that extends outwardly from the gaming system 100 in a player's direction. The player interaction area 112 may contain player input and output systems, including a player control area 114 with one or more input devices 115, a player value acceptor and dispenser area 116, and player convenience input area 118. It should be appreciated that the player interaction area 112 can be placed in other suitable areas of the gaming system 100. In some implementations, the player input and output systems of player interaction area 112 can be positioned in areas apart from each other, such that the player input and output systems are not all contained in a player interaction area 112.

In some implementations, the player control area 114 may include the input devices 115, such as buttons and touch sensitive areas, through with which players may interact with the gaming system 100 to direct game activities. The cabinet 105 can provide an easily accessible location and support for player input and output interactions with the gaming system 100, including gaming control interactions and value wagering interactions. Although the gaming system 100 illustrated in FIG. 1 shows the input devices 115 of the player control area 114 as physical controls (e.g., buttons), it is understood that in some implementations, a player's gaming control inputs could be made using physical controls (e.g., hardware buttons, levers, etc.), "soft" controls (e.g., software driven buttons) located on a gaming display and activated by player touch (e.g., touch screen interfaces), motion detection interfaces, etc. It should be appreciated that a player's gaming control inputs can be made using a suitable combination of input devices.

In some implementations, when a player depresses or selects one of the input devices 115, that input device 115 may cause requests, messages, and/or signals to be sent to one or more processors of the gaming system 100. The input devices 115 may be associated with, but are not limited to the following game controls: game selection button(s) (e.g., where more than one game is provided in a single gaming system 100); gaming denomination value selection button(s); wager selection button(s) for the player to indicate or select the desired wager value for a game; pay line selection button(s) for selecting the number of active pay lines in game implementations that provide multiple pay line wagering; reel spin button(s) for players to initiate one or more reels to spin in a game; a repeat last bet button for players to conveniently repeat the last game's preference and wager selections in a new game; a cash-out button for player extraction of available player credits; an attendant call button; and gaming information buttons such as show pay tables, show game rules, or show other game-related information. It should be appreciated that input devices 115 may include other suitable game control inputs.

The player value acceptor and dispenser area 116 may include one or more value acceptance and value distribution devices 117 that allow the player to interact with the gaming system 100 and input value (e.g., money, currency, etc.) to risk or otherwise place a wager (e.g., a monetary value) on one or more outcomes of a game. The value acceptance and value distribution devices 117 may return winnings to the player via some form of value distribution (e.g., currency, paper ticket vouchers, credit on a player tracking card, credit stored in a central database, etc.). In some implementations, in the player value acceptor and dispenser area 116, a player can supply monetary value to the gaming system 100 via the value acceptance and value distribution devices 117. In some implementations, the value acceptance and value distribution devices 117 may accept any one or more of the following from a player to establish a gaming credit balance: coins, bills, tokens, tickets/vouchers, player ID cards, credit cards, or other suitable forms of value. Thus, if the gaming system 100 accepts coins and bill, the value acceptance and value distribution devices 117 may comprise a currency bill validator and a coin validator. Likewise, if the gaming system 100 accepts tickets, the value acceptance and value distribution devices 117 may comprise a ticket acceptor that receives tickets or vouchers representing some monetary value. The ticket acceptor may include a bar code reader, or other appropriate code reader, for reading the encoded value contained by the player's ticket or voucher. In some implementations, value acceptance and value distribution devices 117 can accept more than one type of value. In some implementations, the player value acceptor and dispenser area 116 may include multiple different value acceptance and value distribution devices 117 that accept different types of value from players.

In some implementations, upon receipt of some suitable type of value from the player, the value acceptance and value distribution devices 117 of the player value acceptor and dispenser area 116 can perform validation on the player supplied value using appropriate hardware readers (e.g., determining that the currency bills/coins/tokens/ticket/voucher/card are genuine). If the validation result is positive on player supplied value, the value acceptance and value distribution devices 117 can generate a message/signal to a processor of the gaming system 100 that establishes a gaming credit balance for playing one or more games on gaming system 100.

In some implementations, the value acceptance and value distribution devices 117 dispenses a monetary value, or a representation thereof, from the gaming system 100 when a player chooses to "cash out" the gaming credit balance (e.g., remove value from the gaming system 100). The player may select an input device 115 associated with a cash out function. The input device 115 may cause a request/message/signal to be sent to a processor of the gaming system 100 to perform a cash out process. The player can cash out at any suitable time. When a player cashes out the value contained on a credit meter (not shown) of gaming system 100, a processor of gaming system 100 may cause a printer included in the value acceptance and value distribution devices 117 to print and dispense a coded ticket or voucher through a dispensing slot to the player. The coded ticket or voucher may be a bar-coded ticket or any other suitable code (PDF517 coding or quick response (QR) coding). This ticket can then be used as value input at another gaming system, or converted to currency at a conveniently located kiosk or cashier counter located near the gaming system. Alternatively, the processor of gaming system 100 may cause a currency bill dispenser or a coin dispenser included in the value acceptance and value distribution devices 117 to dispense the value contained on the credit meter of gaming system 100.

Various combinations of the above value acceptance and value distribution arrangements are possible. The gaming system 100 may include other value acceptance and value distribution mechanisms in the player value acceptor and dispenser area 116. For example, the value acceptance and value distribution devices 117 may include a magnetic strip or chip card reader/writer in order to accept value from and transfer value to a magnetic strip or an embedded chip card. In other implementations, the value acceptance and value distribution devices 117 may include hardware for transferring (and receiving) non-traditional currencies to players such as digital currencies (e.g., bitcoin). In some implementations, the gaming system 100 may update a record of the player's credit meter balance to a remote database.

In some implementations, the value acceptance and value distribution devices 117 may include a card reader that accepts and reads any of a variety of magnetic strip or imbedded chip smart cards that convey machine readable information. The card reader reads inserted cards, in the case of wagering, for the credit information of the player for cashless gaming. The card reader may, for player loyalty programs, utilize the information on the card to identify the player account associated with the card so the gaming activity on the gaming system 100 may be associated with the player account. Additionally, gaming system 100 may include a numeric or alphanumeric keypad (not shown) that enables player entry of a personal identification number or the like for secure access to card information.

In some implementations, a player convenience input area 118 may be included in the gaming system 100, as is shown in FIG. 1. In various implementations, player convenience input area 118 may have a variety of features and functions depending on the jurisdictional deployment of the gaming system 100. In some implementations, the player convenience input area 118 may house a magnetic strip card reader (not illustrated), integrated circuit chip card reader (not illustrated), or both, for reading cards associated with a player loyalty program. Player loyalty programs, also referred to as player tracking systems, provide magnetic strip or chip cards to players for insertion into the gaming system 100 during play. These player loyalty/players tracking cards may be associated with a player account and are utilized by the card-issuing entity to monitor, or track a player's gaming activity and build loyalty through player rewards of a variety of types. The player convenience input area 118 may include an input mechanism such as input buttons so that a player may input a personal identification number or other require player information associated with the player tracking card. Further, the input mechanism may also include a small display utilized to communicate player information to the player such as the player's current loyalty rewards.

In certain implementations, the player convenience input area 118 may include player convenience features such as a pocket for storage that allows players to store their personal items such as a mobile phone. The gaming system 100 may include one or more power charging ports (e.g., universal serial bus (USB) ports, etc.) that enables a player to charge their electronics or connect to services such as the Internet or food service. Further, player convenience input area 118 of the gaming system 100 may include buttons to request food or drink service if the gaming system is located in an establishment that has food and drink service. The gaming system 100 may be connected to a local or wide area network such that selection of the requested food or drink service may alert the establishment's hospitality staff to deliver the requested service directly to the gaming system 100.

The layout of the player control area 114, player value acceptor and dispenser area 116, and the player convenience input area 118 in gaming system 100 may be arranged differently than those disclosed and illustrated herein. The selections and arrangement of player device input locations and player device output locations on the cabinet 105 may be dependent upon the game buttons, the type of value wagered, and the player conveniences utilized in the deployment configuration of gaming system 100.

In some implementations, the lower cabinet body portion 106 includes the first game display device 120, which can be mounted atop or flush with a top panel surface of the lower cabinet body portion 106. The first game display device 120 can be, for example, a 27-inch liquid crystal display (LCD) display mounted in a widescreen orientation. However, any suitable display may be connected to gaming system 100 and placed in any suitable orientation. In the illustrated implementation, the first game display device 120 can be mounted within and framed by first display frame 122 which is, in turn, mounted upon lower cabinet body portion's top panel surface. In this manner, the first game display device 120 is both surrounded and secured within the first display frame 122 and raised above the cabinet's top panel surface. Additional features of the first display frame 122 are described below. Although not illustrated, it is understood that some implementations of the gaming system 100 may use a single first game display device 120 and not include additional game displays. For example, a single first game display device 120 may span the one or more portions of the cabinet 105 (e.g., lower body cabinet portion 106 and upper cabinet portion 126, described below) in place of other display devices (e.g., display devices 130 and 134, described below).

The lower cabinet body portion 106 can also support an upper cabinet portion 126. In some implementations, the upper cabinet portion 126 may be comprised of an upwardly extending support structure (not illustrated) that extends upwardly from the rear side of lower cabinet body portion 106 and configured to mechanically support one or more additional game display devices.

Gaming system 100 may include a cabinet top light 128. In some implementations, the cabinet top light 128 is capable of illumination in a variety of colors and can be utilized to indicate and communicate conditions of the gaming system 100 to gaming players and service personnel.

The upper cabinet portion support structure of gaming system 100 may conceal power and communication lines between (1) the control systems and components located within the lower cabinet body portion 106 and (2) the displays mounted on the upper cabinet portion 126 support structure.

In some implementations, as illustrated in FIG. 1, gaming system 100 may include one or more additional display devices, such as a second game display device 130 and/or a third game display device 134. The second game display device 130 and the third game display device 134 can be disposed generally in a vertical relationship and generally in alignment with the first game display device 120. Like the first game display device 120, the second game display device 130 and the third game display device 134 can be LCD display device or other suitable display devices and can be mounted in any suitable orientation in some implementations. Further, like the first game display device 120, the second game display device 130 and/or the third game display device 134 can be mounted within and framed by second display frame 132 and third display frame 136, respectively. The second display frame 132 and the third display frame 136 can be attached to the upper cabinet support structure and can protect the second game display device 130 and the third game display device 134. In some implementations, one or more of the game display devices 120, 130, and 134 may not include a display frame. In some implementations, one or more of the game display devices 120, 130, and 134 can be housed within a same display frame.

In some implementations, the first game display device 120, the second game display device 130, and the third game display device 134 can be disposed at an angle from each other to form a player-facing concave arc. However, in some implementations, the angles between the game display devices 120, 130, and 134 may be adjustable and may be smaller or greater than the angles illustrated in FIG. 1. Further, it is understood that in some implementations the displays may be disposed in a common plane relative to each other.

It also should be appreciated that in various implementations a variety of display technologies may be utilized equivalently and interchangeably with a variety of implementations of the gaming system. Equivalent display devices include all variations of liquid crystal displays, light emitting diode displays, and plasma displays.

In some implementations, different sized display devices may be combined to display gaming data on gaming system 100. As a non-limiting example, a 27-inch widescreen LCD display may be combined with a 20-inch portrait-oriented LCD or a light emitting diode (LED) display. The display devices could include organic light emitting diode displays (OLED) or other suitable display devices. This combination may be used, for example, with a third scrolling banner LED display. In alternative implementations, one, two, three, or more displays could be used in a variety of positions and orientations. Any suitable combination may be used. It should also be appreciated that a processor of gaming system 100 may communicate with the disclosed first game display device 120, second game display device 130, and third game display device 134 through a video card of gaming system 100 to produce the visible aspects of a game.

In some implementations, one or more of the first game display device 120, the second game display device 130, and the third game display device 134 may be fitted with a transparent touch sensitive overlay for sensing player touch inputs into the gaming system 100. The touch sensitive overlays can communicate with a processor of gaming system 100 to enable the player to interact with a game available on gaming system 100.

In some implementations, curved displays may be used for one or more of the display devices on gaming system 100. Similarly, any of the displays used for gaming system 100 can be based on flexible display technologies. For example, it is possible to utilize flexible display technologies to create uniquely shaped curving, wavy, or tubular display structures to provide one or more of the display devices of gaming system 100. Additionally, in some implementations flexible display technologies can be used in combination with fixed flat screen technologies.

While the gaming system 100 has been described as implemented with video technologies, in some implementations, mechanical game reels with reel strips containing game indicia and step motor controllers may be employed to provide game information to a player. In some implementations, the reel strips may include printed symbols. In another implementation, the mechanical game reels may include flexible video display technology as the reel strips on mechanical game reels. Thus, games implemented in video form can readily be implemented with mechanical game reels utilizing such display technology. Alternatively, in other implementations mechanical game reels with reels strips having fixed symbols displayed along the reel strip could be used to implement the game.

Dependent upon a housing style used in some implementations of the gaming system 100, a variety of other display technologies may be utilized in combination with the gaming system disclosed herein. For example, the gaming system 100 may have one or more display devices in addition to the main game display devices(s) in some implementations. For example, the gaming system 100 may include a player tracking device having a player tracking display which displays various information to the player regarding the player's status. The gaming system 100 may also include other game-related displays such as the wager display and the gaming credit balance meter display. These additional game-related displays may be separate display devices or may be displayed on any one or more of the first game display device 120, the second game display device 130, or the third game display device 134.

The gaming system 100 may also include cabinet lighting that can be used to, among other functions, attract players. In the example gaming system 100 illustrated in FIG. 1, attractive cabinet lighting is provided by frame accent lighting 138. The frame accent lighting 138 can be placed around any number of structures of gaming system 100. For example, the frame accent lighting 138 can be placed around the first display frame 122, the second display frame 132, the third display frame 136, and/or player interaction area 112.

The frame accent lighting 138 may include multiple components. In some implementations, the side edge pieces of the first display frame 122, the second display frame 132, the third display frame 136, and the edge structure of player interaction area 112 can be made of a translucent or transparent plastic or other suitable materials. Linear arrays, or strips, of light emitting diodes (LEDs) (not shown) on circuit boards may be mounted below or on the surface of the side edge pieces. In some implementations, the circuit boards are flexible circuit boards. These LED strips and transparent or translucent coverings may surround one or more gaming system displays frames, as well as the player interaction area, to highlight these areas.

In some implementations, the individual LEDs mounted on the LED strips are of a type that can emit red, green, and blue light. In an alternative implementation, separate LEDs are used for the light colors. In some implementations, the LEDs or LED strips can be electrically connected and can be controlled by a cabinet lighting controller (e.g., cabinet lighting controller 218 in FIG. 2) in conjunction with a processor of the gaming system 100 to selectively mix the emitted light colors in a manner to create any color. The cabinet lighting controller can flash and vary lighting as desired. For example, cabinet edge lighting can change and flash in combination with music rhythms or in combination with game events. Other suitable variations are possible.

In some implementations, the cabinet 105 may include LED strip lighting or LED rope lighting to accentuate the cabinet and enhance the attractiveness of the gaming system 100 to players. LED rope lighting is a number of small light-emitting diode bulbs linked together and encased in a plastic, polyvinylchloride, or other suitable material to create a string of lights. For example, in one implementation illustrated in FIG. 1, the cabinet 105 includes cabinet accent lighting 140. In some implementations, the cabinet accent lighting 140 is LED rope lighting mounted flush with the front side edge of the cabinet side panels 108. The LED rope lighting can generate any of suitable colors, and are controlled by cabinet lighting controller and a processor of the gaming system 100 to selectively mix the emitted light colors in a manner to create any color in the same manner as the frame edge lighting.

In various implementations, the gaming system 100 includes one or more audio speakers 142 and appropriate driving electronics and sound cards so that game players may experience pleasing audio aspects of the gaming system 100. Audio is desirable to attract and maintain player interest in the gaming system 100. The gaming system 100 may also emit attraction sounds during any idle period of the gaming system 100. Game audio may add to the player's enjoyment of the gaming system 100 by providing music and sound effects designed to enhance and compliment the gaming experience. In FIG. 1, the audio speakers 142 are shown mounted on the upper corners of the second display frame 132. Any suitable number of additional audio speakers 142 may be provided on additional display frames or on the lower cabinet body portion 106 as desired.

The audio speakers 142 designed for emitting bass vibrations may be included in some implementations. Placement of the audio speakers 142 may be selected to enhance the sound emitting characteristics of the gaming system 100. For example, bass speakers or additional speakers 144 may be mounted inside lower cabinet body portion 106. Further, it is envisioned that in some implementations sound processing such as multichannel processing and surround sound processing are included in gaming system 100. Audio jacks for attachment of player headphones may also be provided in some implementations of gaming system 100 for the player to further enhance the audio experience of the game and to block out noise from other gaming systems.

In some implementations, the front panel 110 of the lower cabinet body portion 106 includes a removable panel or door, which can be opened for access to internal control system and technology components that are housed within the lower cabinet body portion 106 (discussed hereinbelow with respect to FIG. 2). The removable panel or door can be locked in some implementations. The front panel 110 may be flanked on vertical sides by cabinet side panel extensions 146 which serve to define a space below the player interaction area 112 for players to place their feet and legs while they are playing the gaming system 100 in a seated position. A foot rest 148, which may be cushioned, can positioned below the player interaction area 112 to enhance a player's ergonomic comfort while playing the gaming system 100. In some implementations, the edges of the player interaction area 112 may be ergonomically cushioned as well.

The gaming system 100 may be constructed using other suitable alternative forms and styles of gaming system housings that are not shown. For example, the cabinet 105 may have fewer or greater number of display devices for displaying games and game-related information to the player. If multiple display devices are used, the display devices may be of similar size, shape, and orientation or the display devices may be divergent from each other in one or more of their respective characteristics. The one or more display devices can be supported by, mounted upon, or contained within the cabinet 105 which can comprise a variety of shapes, sizes, and forms. The cabinet 105 can: protect and house the operational electronics; adequately support the display(s) in a position easily viewable for a seated or standing player, as necessary; and/or provide an easy location and support for all necessary player input/output systems, including gaming control interactions and wagering interactions. For example, in some implementations the gaming system 100 may include a housing style referred to as a "slant top" gaming device that is designed to be operated with the player comfortably seated. In this arrangement, generally, the gaming display(s) and all player input and output controls are located on a low, wide, surface that extends forwardly from the player on a horizontal plane and then slopes upwardly and away from the player's seated location.

In some implementations, housing styles of the cabinet 105 of gaming system 100 may include bar top or table top housing arrangements. These housings are generally small enough to be placed on top of an existing bar or table while providing the requisite gaming system housing functions of protection of/access to gaming electronics, displays, and player input and output functions described above.

In some implementations, the cabinet 105 may be an embedded housing. Embedded housings are built into structures designed to otherwise function as bars or tables in a gaming environment. Displays may be integral with the bar top or table top surface or the entire unit may be contained below a transparent bar or table top surface while controls are disposed on the lower front or side of the bar or table.

Figure 2:
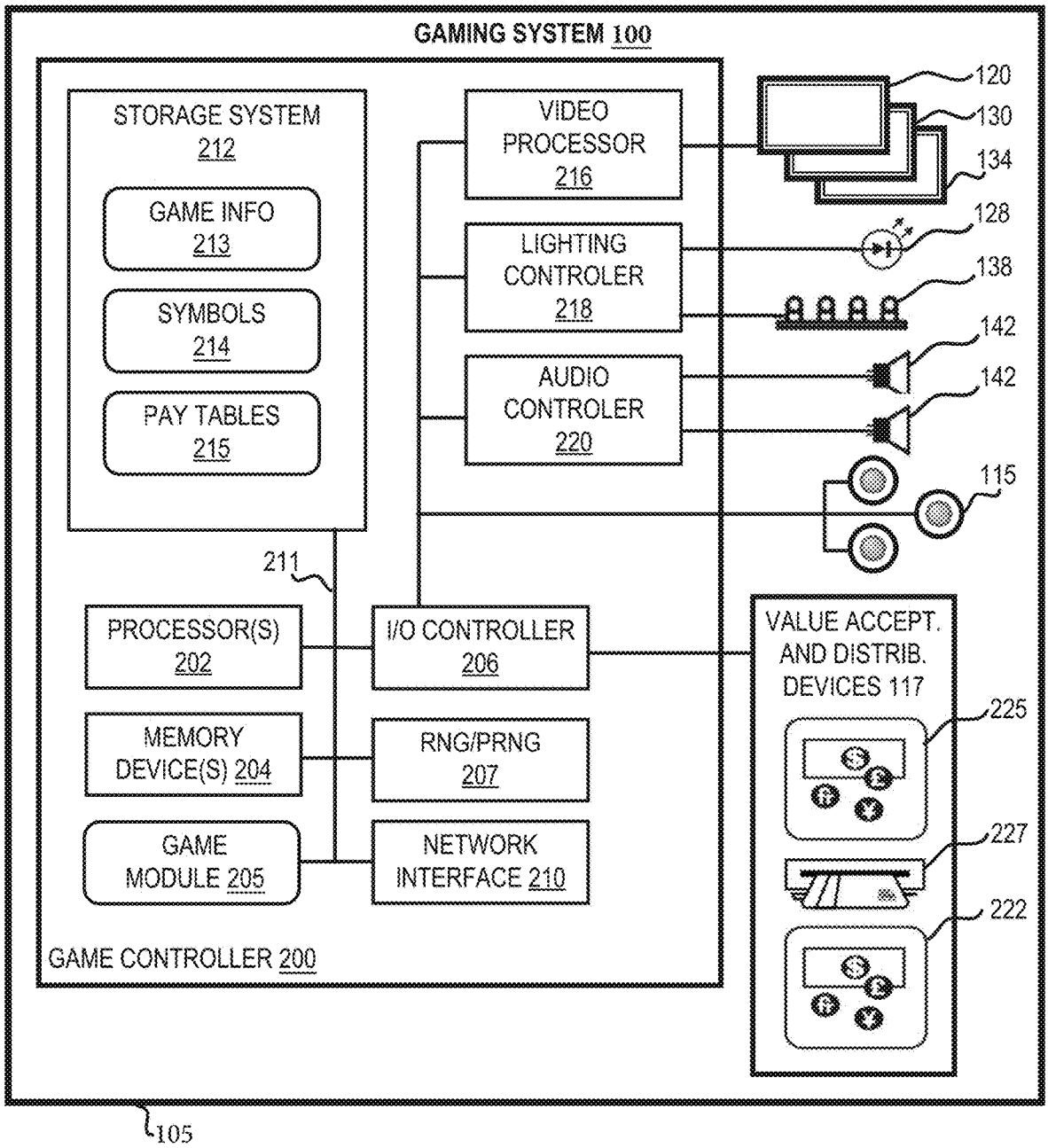
FIG. 2 shows a functional block diagram illustrating a game controller and gaming system in accordance with aspects of the present disclosure.

FIG. 2 shows a functional block diagram illustrating an example of a game controller 200 of a gaming system 100 in accordance with aspects of the present disclosure. The gaming system 100 can include a cabinet 105, one or more player input devices 115, one or more value acceptance and distribution devices 117, one or more display devices 120, 130, and 134, a cabinet top light 128, accent lighting 138, and one or more audio speakers 142, which can be the same or similar to that previously described herein. Additionally, implementations of the game controller 200 may include one or more processors 202, one or more memory devices 204 (e.g., random access memory, read only memory, etc.), one or more game modules 205, one or more input/output (I/O) controllers 206, one or more random number generators 207, one or more network interfaces 210, one or more communication channels 211 (e.g., a data bus), one or more video processors 216, one or more lighting controllers 218, and one or more audio controllers 220. In accordance with aspects of the present disclosure, the game controller 200 is configured to perform specialized game functions and operations, consistent with the implementations described herein. The functional elements shown in FIG. 2 cooperate, on a broad and general level, to function as a gaming system providing the functionality and operations detailed below. Such functionality and operations can be embodied in hardware, software, or a combination thereof. It is understood that the below described hardware includes the structures described, as well as the functional or operational equivalents of such structures. Further, it is understood that the below-described functions and operations can be performed by hardware, digital circuitry, computer software, computer firmware, or functionally equivalent combinations thereof.

The processor 202 can be one or more general-purpose processors, special-purpose processors, or other programmable data processing apparatuses providing the functionality and operations detailed herein. In some implementations, the processor 202 is specially configured with arithmetic logic units and math co-processors, also known as floating point units, for executing one or more games consistent with the various implementations disclosed herein. In some implementations, the processor 202 includes registers for holding instructions or other data, and cache memory for storing data for faster operation thereupon.

A controller, in some implementations, is a device or a software program that manages or directs the flow of data between two entities. Often, controllers are special purpose circuitry or software that solve a technical communications problem between different technology systems. In some implementations, a controller functions as an interface between two systems while managing the communications between the systems. In another implementation, a controller functions as an interface between a processor and a peripheral device and functions to control the peripheral device.

The memory device 204 and storage system 212 can be operatively and/or communicatively connected to the processor 202. In some implementations, the memory device 204 and/or the storage system 212 includes one or more types of memory structures. For example, the memory structures can include random access memory (RAMs) units, read only memory (ROMs), flash memory (e.g., solid state drives (SSDs)), electrically erasable/programmable read only memory (EEPROMs), etc. It should be appreciated that in some implementations, communication between the memory device 204, the storage system 212, and the processor 202 or another controller, encompasses the processor or controller accessing the memory device 204 and/or the storage system 212, exchanging data with the memory device 204 and/or the storage system 212 (e.g., reading/writing data to the memory device 204), or storing data to the memory device 204 and/or the storage system 212.

The memory device 204 and/or the storage system 212 may store program code, game code (collectively the "code" or "program instructions," such as game module 205), and operational data (e.g., game info 213, symbols 214, and pay tables 215, or other suitable data) used in the operations of the game controller 200 to provide a gaming system that executes the gaming functions described hereinbelow. In an alternative implementation, the code and the operational data for the operation of the game controller 200 may be stored in a distributed manner such that some code is stored in memory device 204 (or storage system 212) and other code is stored remotely from the game controller 200. In some implementations, the code and the operational data used the operation of the game controller 200 includes, for example, basic input and output function data, instruction fetching data, bus and network communication protocol data, and like data for an operational gaming system. In some implementations, the code (e.g., the game module 205) and the operational data (e.g., game info 213, symbols 214, and pay tables 215, or other suitable data) used for the execution of the gaming features includes, for example, game image data, game rule data, pay table data, game mode and timing data, gaming value and wager parameter data, and random or pseudo-random number generation data.

In addition to the memory device 204 described above, in some implementations, the code and operational data for the operation of the gaming system described above may be stored in the storage system 212. The storage system 212 can be removable game cartridges or flash drives, a compact disk ROM, a digital versatile disk (DVD) optical storage technology, or suitable other fixed, non-transitory computer-readable storage devices. In some implementations, part or all of the code and operational data for operation of the gaming system or for execution of the game features may be stored in a remote memory structure and be downloaded to the memory device 204 via a network connection.

In some implementations, the game controller 200 may utilize any combination of computer-readable memory devices, such as random-access memory devices (RAMs), unalterable memory devices (ROMs), and mass storage devices for securely storing and securely communicating the software components or code that facilitate game play and other functions of the game controller 200. The memory device 204 may store software components or code that include various game data and game related control and execution software. In some implementations, the software components stored in the memory device 204 may include gaming system initialization software, system basic input and output software, operating system software, value acceptor software, value dispenser software, display image generation software, game symbol set image generation software, game rule execution software, game data set(s), random number generation software, system driver software, system data bus management software, audio generation and speaker driver software, and video generation and display driver software, and any other suitable software routines for operation of the game controller 200.

In some implementations, the memory device 204 and the storage system 212, with the software components, code, operational data, and other information may be secured and authenticated by authentication software stored in an unalterable memory device within the housing of the game controller 200. The game controller 200 may also include application specific integrated circuits (ASICs) to perform the security and authentication functions. At various time or events, such as before each play of a game, at a predetermined interval, upon transfer of any game data or any software components from a mass storage to the memory device 204, or upon demand, the game controller 200 (using a processor such as a processor 202 or a separate ASIC) may execute an authentication routine and perform an authentication of any software component or other data of the game controller 200. In some implementations, the software components of the gaming system 100 and game controller 200 may be prepared for authentication via creation and storage of an encrypted signature unique to one or more of the software components.

In some implementations, an encrypted signature may be created by utilizing a hash function on a software component or code to form a message digest (e.g., a hash of the software component) followed by a key encryption of the message digest to form an encrypted signature unique to the software component. In some implementations, the key encryption may be public key encryption, private key encryption, or any suitable key encryption schema. The encrypted signature may be stored with the gaming system software component, for example, in a mass storage device or an unalterable memory. During a software component authentication, the gaming system 100 executes one or more authentication routines utilizing the same hash function to operate on the software component to compute, or re-create, a new message digest for the software component. The new or re-created message digest may then be compared with a previously created message digest obtained by decrypting the stored encrypted signature. Matching message digests between the new and previously created message digests indicate that the software component is authentic and the game controller 200 may allow game play to proceed. In some implementations, when the message digests do not match, the game controller 200 may determine that the software component under authentication may be corrupted or fraudulent and game play may be halted. It should be appreciated that the game controller 200 may perform other suitable security and authentication checks on the game data or software components. Such authentication and security devices and functions are unique to gaming and casino industry to minimize or prevent fraud in gaming devices and gaming systems.

For a player to interact with the gaming system 100, the game controller 200 receives and processes player inputs from, e.g., input devices 115, and the game controller 200 causes processed results to be output or communicated to the player. In some implementations, the player inputs are recognized and processed or directed for processing by input/output (I/O) controller 206. Further, the I/O controller 206 may process and direct player outputs for communication to the player. The I/O controller 206 can function as the intermediary between the processor 202 and one or more input devices to control information and data flow therebetween. The I/O controller 206 may also function as the intermediary between the processor 202 and one or more output devices to control information and data flow therebetween. The I/O controller 206 is configured to understand the communication and operational details (such as hardware addresses) for the attached input devices and output devices. In this manner, processor 202 can be freed from the operational details of the peripheral I/O devices in some implementations. For example, in some implementations where an input or output device is changed or upgraded, the I/O controller 206 can be changed or updated without changing other gaming system components.

In some implementations, a player deposits value into a gaming system by inserting some form of currency or value into a value acceptor 225 for game play. Alternatively, a player deposits value into a gaming system by inserting an encoded paper ticket into a value acceptor 225 for game play in some implementations. The value acceptor 225 can be combined with a currency reader and validator, and a code reader for reading value encoded on paper tickets. In some implementations, the gaming system 100 may include different hardware for the paper ticket reader from the currency reader and validator. The value acceptor 225 may read, validate and communicate the amount of the inserted value to the processor 202. The processor 202 can establish a gaming credit balance for the player based on the communication from the value acceptor 225. The processor 202 can also communicate the player's credit balance on a credit balance meter display of the gaming system 100. During game play, the processor 202 may process a player's wagers and determine an amount of credits to debit from the player's credit balance. When a winning outcome is obtained, the processor 202 is configured to determine an amount of credits to add to the player's credit balance. It should be appreciated that the gaming system 100 may use one or more different processors to perform such calculations.

As previously mentioned with respect to FIG. 1, gaming system may use one or more of a variety of value acceptance systems. In some implementations, the value acceptor 225 could include magnetic strip or chip card readers to accept and transfer value. The value acceptor 225 may also be configured to accept and transfer non-traditional currencies such as digital currencies. In these implementations, I/O controller 206, a processor 202, or both may be configured with appropriate control instructions to communicate with the value acceptor 225 and extract value from the inserted item containing value. In some implementations, use of a magnetic strip or embedded chip card, for example a bank card, for value insertion requires the processor 202 to communicate, via network interface 210, with devices external to a gaming system 100.

In some implementations, a card reader 227 may be included in gaming system 100 to accept player loyalty cards. For example, the card reader 227 can extract account identifying information from the card and utilizes this information to access the associated account information stored remotely via the network interface 210. In implementations where player loyalty/player tracking systems are used with the gaming system 100, a player's loyalty account and record of gaming activity can be stored in a networked storage location or database. In some implementations, the processor 202 is configured to record the player's gaming activity in the memory device 204 and/or the storage system 212 during the duration of loyalty card insertion. When the loyalty card is removed from the card reader 227, recorded gaming activity is uploaded, via the network interface 210, to the remote storage location associated with the player's account in some implementations. In this manner, the player's gaming activity can be further processed and analyzed, and the player can be awarded loyalty rewards based upon his activity data at the gaming system 100.

In various implementations, the input devices 115 receive a player's game inputs and communicates the player's game inputs to the processor 202. The player's game inputs may include, but are not limited to, wager amounts, pay line selections, game control signals, game selections, and cash-out requests/signals. In some implementations, the input device 115 may generate signals/requests based on button presses, touch screen activations, or voice control. In some implementations, the player-initiated signals can be communicated to the processor 202 by the I/O controller 206. Further, the player-initiated signals may direct and inform execution of the game instructions stored in the memory device 204 and configured to be executed by the processor 202 in some implementations.

In some implementations, the gaming system 100 may include mechanical game reels and other electro-mechanical components to provide game displays and game outcomes (not shown). For example, mechanical game reels (e.g., mechanical game reels rotatable about a common axis) may include indicia or symbols fixedly positioned around the periphery of the mechanical game reels. The indicia or symbols fixedly positioned around the periphery of a mechanical game reel may form a reel strip. The indicia or symbols fixedly positioned on reel strip may comprise a set of symbols for that reel strip or reel. The indicia or symbols on the mechanical game reels are generally associated with separate, detectable reel stop positions. In some implementations, the mechanical game reels can be set into a spinning/rotation motion by pulling a lever or pushing a button of the gaming system 100. In some implementations, the gaming system 100 can stop the game reels by allowing the mechanical game reels to stop naturally, or actuating a suitable mechanical or electro-mechanical reel brake on a random timing basis. When the mechanical game reels stop rotating, the gaming system 100 may, using suitable detection mechanisms, determine one or more displayed stop positions of the mechanical game reels. Since the displayed stop positions of the mechanical game reels can be associated with respective indicia or symbols, the gaming system 100 can determine what combination of indicia or symbols are displayed at the stop positions. The gaming system 100 can also determine whether the displayed indicia or symbols result in one or more winning symbols and/or winning symbol combinations for a game outcome.

In some implementations, the displayed stop positions (e.g., corresponding to displayed indicia) can be determined using random numbers associated with the displayed stop positions/indicia/symbols of the mechanical reels. In some implementations, the processor 202 is configured to execute stored program code and instructions which generate random numbers or pseudo-random numbers for determining the displayed stop positions of the mechanical reels. The gaming system 100 can use the randomly generated numbers to determine which stop positions of the reels should be displayed for a game outcome.

In some implementations, a random number generator (RNG) 207 is a software module configured to be executed by the processor 202 for the generation of a true random or pseudo-random number. The code for RNG 207 may be stored in the memory device 204 or the storage system 212. The RNG 207 generates random numbers for use by the gaming system 100 during game execution. In some implementations, the gaming system 100 can utilize the random numbers for the random selection of one or more symbols (e.g., stop positions) along mechanical game reels.

In some implementations, the gaming system 100 uses video-based reels as simulations of the mechanical reels to provide game displays of game outcomes. In some implementations, the video-based reels are used in place of mechanical reels. In some implementations, the video-based reels are used in conjunction with mechanical reels or other mechanical components. Like a mechanical game reel, a video-based reel can be associated with a reel strip, where the reel strip includes a set of symbols or indicia. The set of symbols or indicia for a reel strip may be fixed or dynamic in various implementations. In some implementations, indicia or symbols can include, but are not limited to, numbers, letters, geometric figures, symbols, images, character, animations, blank symbols (e.g., the absence of symbols), or any other suitable graphical depiction. The gaming system 100 may include one or more video-based reels for a game. The gaming system 100 may include a particular reel strip associated with a particular video-based reel. In some implementations, each video-based reel can be associated with a separate reel strip (e.g., a separate set of symbols). The reel strips can be the same or different for different video-based reels. It should be appreciated that the language "reel strip(s)" is used merely for illustration purposes throughout this disclosure. In some implementations, predetermined reels strips may be used. In other implementations, a reel strip is a representation of a set of symbols, where symbols in the set of symbols are associated with a probability of being determined or generated for display in the visible symbol display areas of a video-based reel. Different reel strips (e.g., different sets of symbols) may include the same symbols associated with the same or different probabilities of being determined or generated. In some implementations, different reel strips may include different symbols. It should be appreciated that in some implementations, indicia or symbols can be used independently of a video-based reel. That is, some games on gaming system 100 may not use video-based reels or reel strips, but use random number determinations for game outcomes.

Returning to random number generation, symbols in the reel strips or sets of symbols can be associated with numbers for video-based reels similar to mechanical game reels. In some implementations, when the RNG 207 selects a number, a processor in conjunction with the memory devices 204 of the gaming system 100 can correlate the selected number to an associated symbol to determine what symbol has been randomly selected. In various implementations, once symbols are randomly selected based upon the random numbers generated by the RNG 207, the processor 202 can evaluate the displayed patterns of symbols or randomly determined numbers to determine one or more game outcomes. It should be appreciated that in some implementations, gaming system 100 may include a hardware based random number generator that is in communication with processor 202 to supply random numbers for random game symbol determination purposes. The hardware based random number generator may be incorporated into the processor 202 or can be separate from the processor 202.

Returning to FIG. 2, the game controller 200 controls the function and output of output devices utilized by a gaming system. In various implementations, the I/O controller 206 serves as an interface unit between the processor 202 and output devices, such as video processor 216, cabinet lighting controller 218, audio controller 220, and value dispenser 222.

In some implementations, the video processor 216 communicates with the processor 202 to render at least some of the game graphics, video displays, and information on one or more video display devices (e.g., game display devices 120, 130, and 134). In some implementations, the video processor 216 includes one or more processors, controllers, and/or graphics cards for processing the game images, outcomes, and animated displays and coordinating the processed data to be display between, among, or across any or all display devices. In various implementations, this may include being configured to simulate objects and the movement of objects which represent video game reels containing symbol sets.

It should be appreciated that in certain other implementations where gaming system 100 includes physical mechanical game reels to display game symbols or other game features, reel controllers and stepper motors can be provided in lieu of or in addition to video processor 216.

In implementations which utilize cabinet lighting as described with respect to FIG. 1, a cabinet lighting controller 218 may be utilized to coordinate and control the color and timing of cabinet lighting displays with processor 202. In certain implementations which utilize sound design, processor 202 may utilize audio controller 220 to coordinate and control the sound emissions. In some implementations, audio controller 220 may include one or more audio processing cards for generating sound and for driving the one, two or more speakers 142 that may be included with the gaming system 100.

In various implementations, players may request their remaining credit value by selecting one of the input devices 115, which in turn makes a request or initiates a signal that is communicated to the processor 202, such as via the I/O controller 206. In some implementations, the signal triggers a readout of the player's credit balance from a credit balance meter and the processor 202 initiates a value dispensing signal which, in turn, can be communicated to the value dispenser 222. In some implementations, the value dispenser 222 can be controlled to issue the player's credit value using any of the types of value discussed herein. In some implementations, the player's credit value may be issued to the player via a printed and dispensed encoded paper ticket or token which the player can then exchange at a special purpose kiosk or cashier location for the monetary value encoded into the ticket or token. In some implementations, the processor 202 can direct the value dispenser 222 to issue to the player an appropriate amount of coin or bills directly to the player. Additionally, or alternatively, in some implementations, the player may have the option to electronically direct the credit value to an account associated with the player. It should be appreciated that any suitable combination of forgoing may be available at gaming system 100.

In some implementations, the game controller 200 may communicate with one or more devices outside the gaming system 100. For example, gaming system 100 may be connected to a larger network via a local area network (LAN) or a wide area network (WAN). The game controller 200 may communicate with one or more central servers, controllers, or remote devices to execute games, establish credit balances, participate in progressive jackpots, etc. In some implementations, network communications and connections can be accomplished via a network interface 210. Network interface 210 can be a digital circuit board or card installed in game controller 200 to provide network communications with external devices. Network interface 210 may include wired and/or wireless communication hardware.

In some implementations, various additional features and functions are performed by the game controller 200. For example, the game controller 200 may be specially configured with software to track game play events that occur on the gaming system 100. In some implementations, the game controller 200 may audit recorded monetary transactions, including wager amounts, game outcomes, game winnings, and game payouts that occur through the value dispenser 222. Further, some implementations of gaming system may include security software to assist in protecting the gaming system 100 from tampering or alteration attempts.

Figure 3:
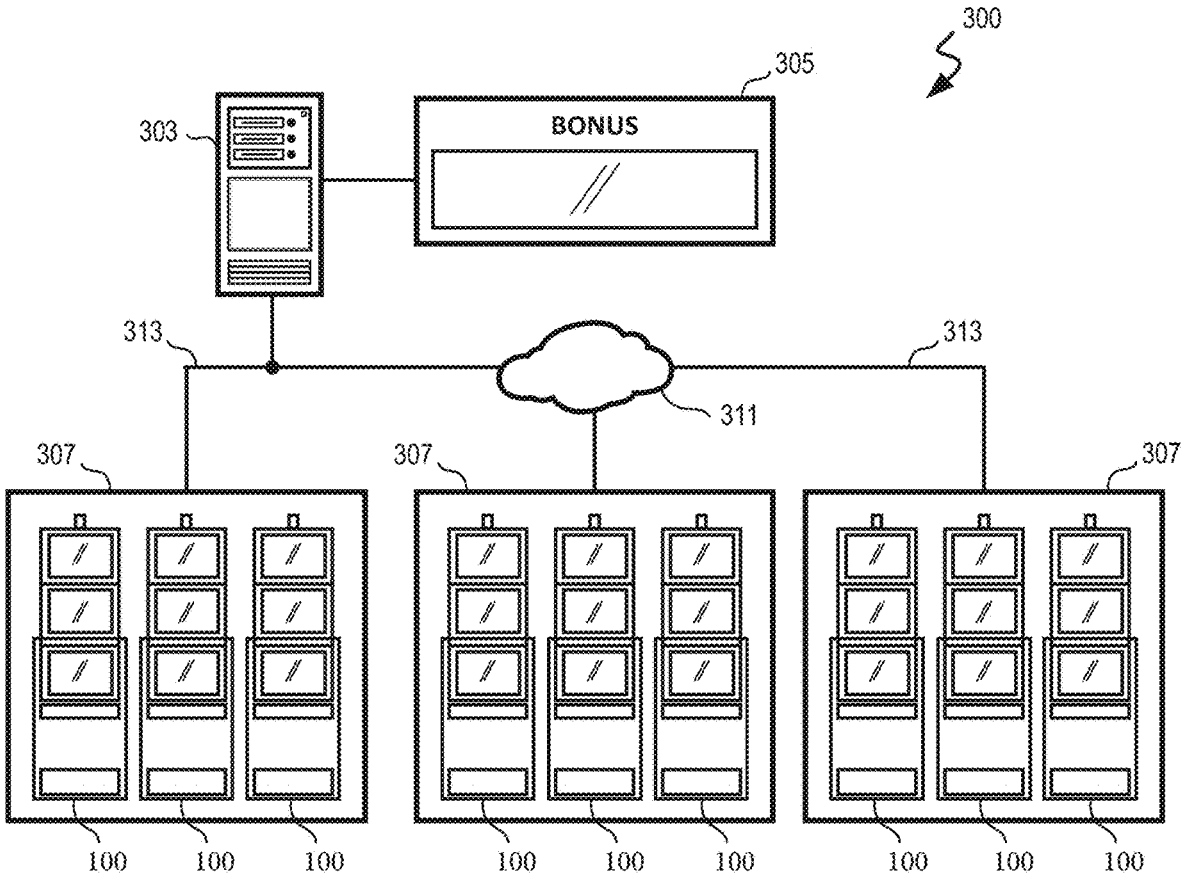
FIG. 3 illustrates an example of an environment for implementing systems and processes in accordance with aspects of the present disclosure.

FIG. 3 illustrates an example of an environment 300 for implementing systems and methods in accordance with an implementation of the present disclosure. The environment 300 includes a bonus server 303 and a bonus display 305 that are functionally connected with one or more banks 307 of one or more gaming systems 100 via a network 311 and one or more wired or wireless communication links 313. The bonus server 303 can be one or more computing devices comprising hardware, software, or a combination thereof that manages bonus games provided by the gaming systems 100 of one or more of the banks of gaming systems 307. In some implementations, the bonus server 303 functions to collect and maintain funds for one or more bonuses, display the values of the bonuses using the bonus display 305, and provide the bonuses to the gaming systems 10. For example, the bonus server 303 can maintain different pools of funds corresponding to different bonus levels (e.g., small, large, and grand/jackpot bonuses). In some implementations, the bonuses can be progressive bonuses in which the bonus server 303 incrementally accumulates the pools from wagers made at the gaming systems 100.

The bonus display 305 can include one or more display devices that display values of the bonuses managed by the bonus server 303. The bonus display 305 can be a video display or a mechanical display device. For example, the bonus display 305 can be a cathode ray tube (CRT) display, a liquid crystal display (LCD), a light-emitting diode (LED) display, a flip card display, a reel display, etc. The bonus display 305 may be located so as to be viewable by players of the gaming systems 100 in a same location or a same bank 307. In some implementations, the banks 307 of gaming systems 100 can be collocated within view of the bonus display 305. While FIG. 3 shows a single bonus display 305, it is understood that the environment 300 can include more than one bonus display 305. In some implementations, multiple bonus displays 305 may be used, such as when some of the banks 307 are at different physical locations. In some implementations, the individual gaming systems 100 can include respective bonus displays 305. For example, the gaming systems 100 can include respective top displays (e.g., display device 134 in FIG. 2) repeating the function and information provided by the bonus displays 305. The bonus displays 305 connected to the network 311 may have substantially the same information displayed. For example, while individual banks 307 or the gaming systems 100 may have different games or themes, such banks 307 and the gaming systems 100 may participate in bonus games having a common bonus pool that is managed and paid out by the bonus server 303 based on certain game features occurring.

The banks 307 can include two or more of the gaming systems 100 that may be at the same or different locations as the bonus server 303 or one another. The locations can be different spaces within a single facility (e.g., casino, airport, or mall) or in spaces at separate locations. In some implementations, a bank 307 may include a single gaming system 100.

The network 311 can be a wired or wireless computer network that functions to exchange information between the bonus server 303 and the gaming systems 10. The network 311 can be, for example, a peer-to-peer network, a local area network, a wide area network, or the Internet. The network 311 may be located in a single location or spread over multiple locations and may be connected to other networks.

The gaming systems 100 in the network 311 may include displays for a main game and a bonus game (e.g., game display devices 120, 130, and 134). The bonus game may be common to the gaming systems 100, while one or more of the gaming systems 100 may provide different base games. The bonus may be provided when certain criteria at one of the gaming systems 100 are achieved in the bonus game. The criteria may be, for example, the display of a particular symbol or symbol combination, or a particular outcome of the bonus game.

In some implementations, the gaming systems 100 may participate in multiple bonus games having respective bonus awards. For example, a first bonus may be available when the player makes a small wager, a second, larger bonus may be available when the player makes a larger wager, and a third, still larger bonus may be available when the player makes an even larger wager. It understood, however, that the different bonus levels available may not be associated with wagers of a player. Instead, for example, all of the different bonus levels may be available to the player and the award of a particular level may correspond to the outcome of the bonus game.

Gaming System Operation

Figure 4A:
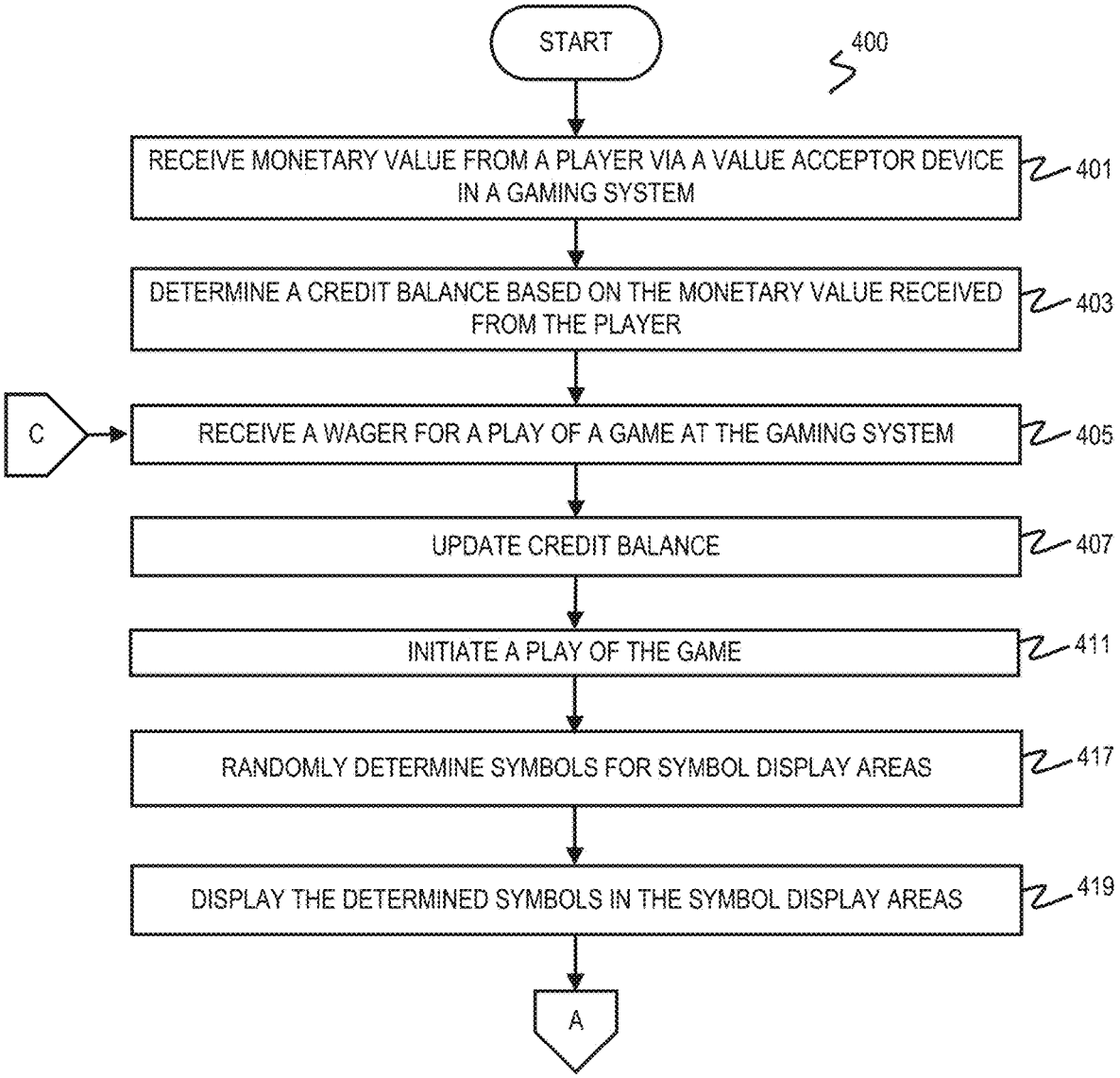
FIGS. 4A, 4B, and 4C show a process flow diagram illustrating an example method of operating the gaming system in accordance with aspects of the present disclosure.
Figure 4B:
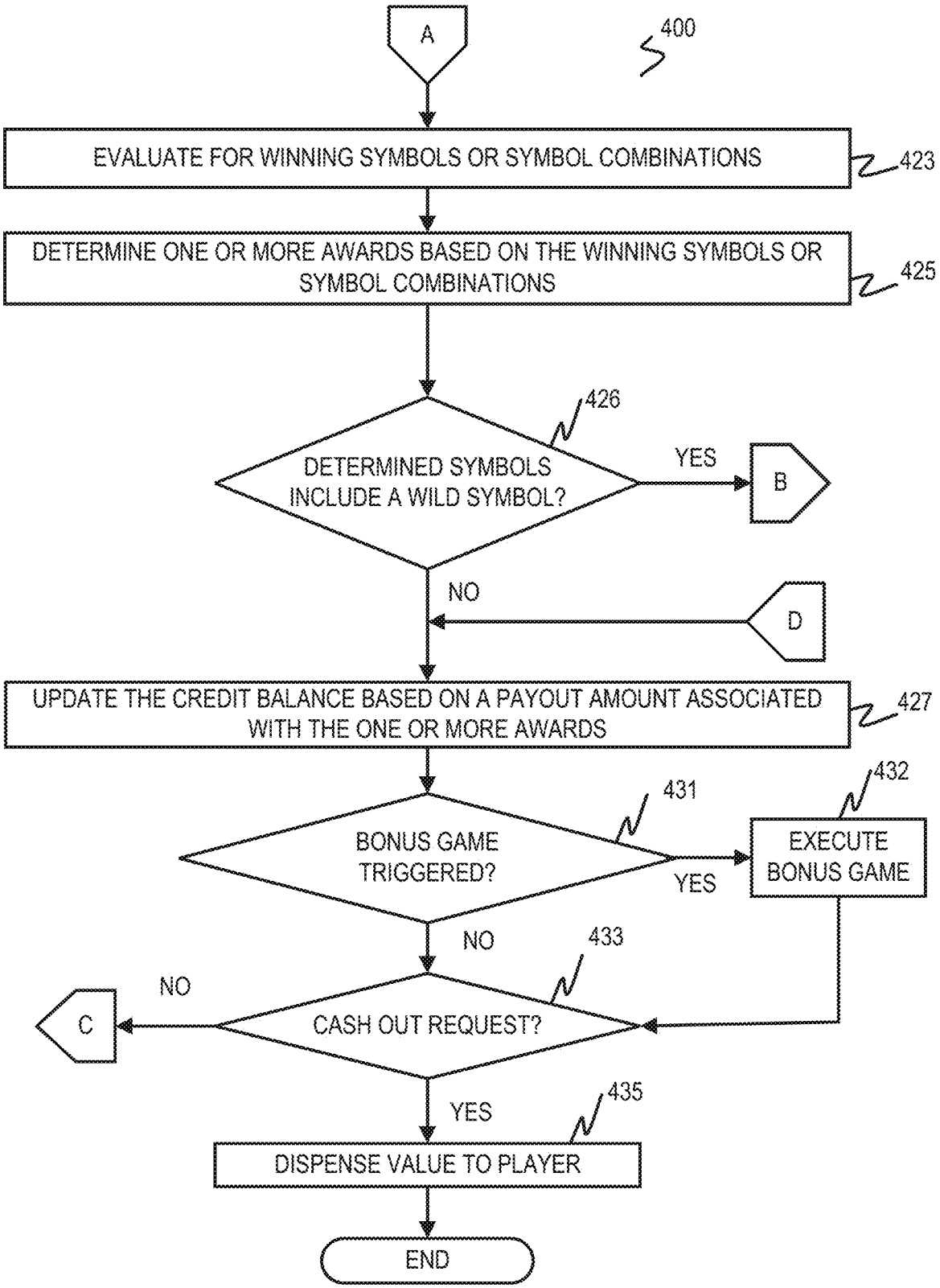
Figure 4C:
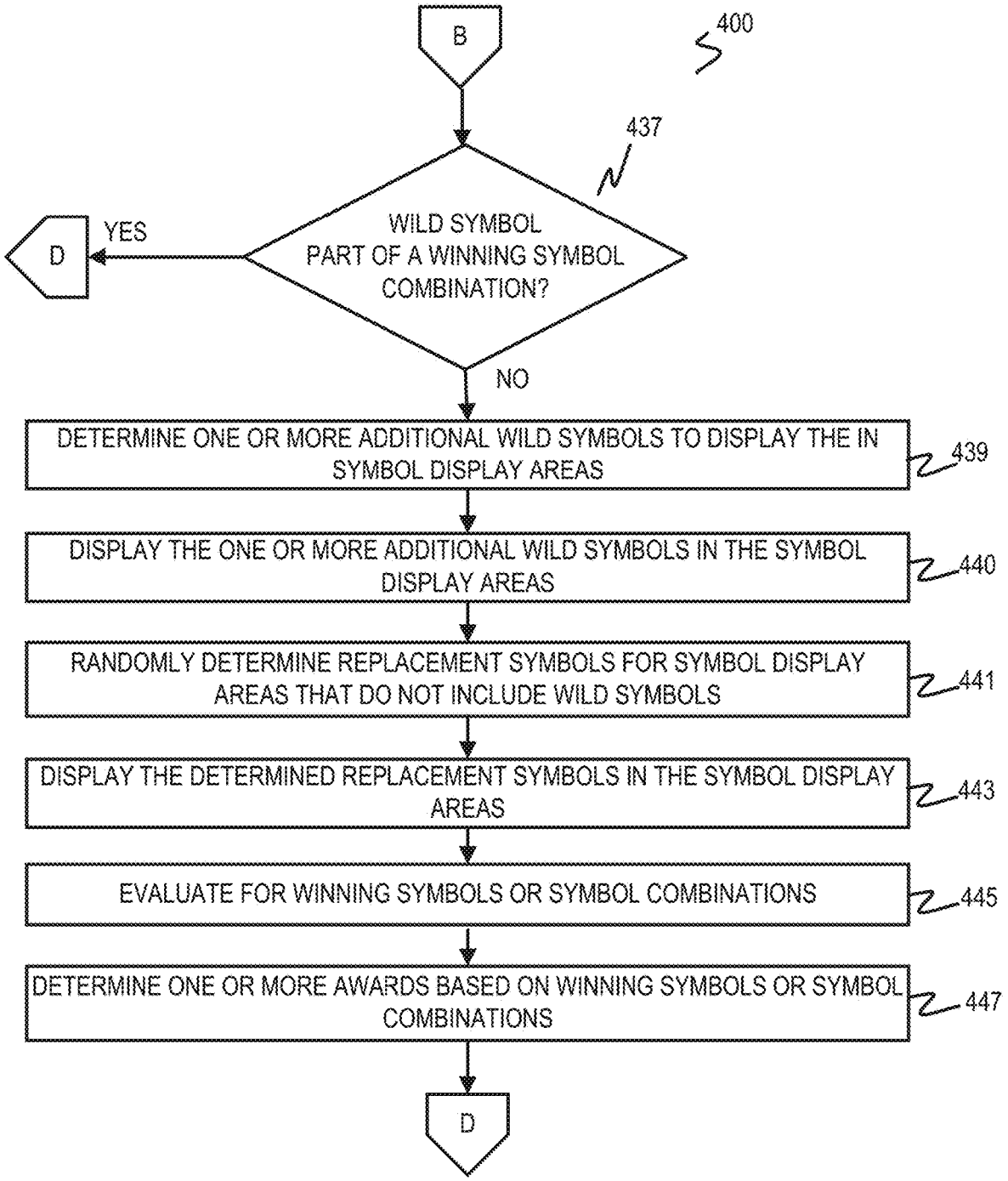

The flow diagrams in FIGS. 4A-4C illustrate functionality and operations of systems, devices, processes, and computer program products according to various implementations of the present disclosure. Each block in FIGS. 4A-4C can represent a module, segment, or portion of program instructions, which includes one or more computer executable instructions for implementing the illustrated functions and operations. In some implementations, the functions and/or operations illustrated in a particular block of the flow diagrams can occur out of the order shown in FIGS. 4A-4C. For example, two blocks shown in succession can be executed substantially concurrently, or the blocks can sometimes be executed in the reverse order, depending upon the functionality involved. Additionally, in some implementations, the blocks of the flow diagrams can be rearranged in different orders. Further, in some implementations, the flow diagram can include fewer blocks or additional blocks. It is also noted that each block of the flow diagrams and combinations of blocks in the flow diagrams can be implemented by special-purpose hardware-based systems that perform the specified functions or acts, or combinations of special-purpose hardware and computer instructions.

FIGS. 4A-4C show a process flowchart illustrating an example of a method 400 of operating a gaming system (e.g., gaming system 100) in accordance with aspects of the present disclosure. FIGS. 4A-4C describe parts of a game, including a first part of the game and a second part of the game that may be enabled by events in the first part of the game. In some implementations, the first part of the game is a base or primary game and the second part of the game is a bonus game that may be triggered from events in the base game. However, it is understood that FIGS. 4A-4C may be integrated as a single game in which the elements of the second part of the game occur in the first part of the game. In some implementations, one or more processors (e.g., processor 202) of the gaming system are configured, via instructions (e.g., gaming module 205) stored in a memory device (e.g., memory device 204 or storage system 212) to perform the method 400.

In some implementations, a play of a game begins when the gaming system receives a monetary value from a player (e.g., block 401). In other implementations, a play of the game begins when the gaming system receives a wager (e.g. block 405). The play of the game can end when the first part of the game is complete and a second part of the game is not triggered or otherwise initiated (e.g., block 431, "No"). In some implementations, the play of the game can also end when the gaming system receives a request to cash out (e.g., block 433, "Yes"). In some implementations, blocks 433 and 435 are not part of a play of a game. In alternative implementations, blocks 433 and 435 are part of a play of a game.

Turning to block 401 in FIG. 4A, the gaming system (e.g., gaming system 100) performing the method 400 receives a monetary value via a value acceptor device (e.g., value acceptor 225) in block 401. In block 403, the gaming system determines a credit balance based on the monetary value received in block 401. In block 405, the gaming system receives a wager for a play of a game from a player via an input device (e.g., input device 115) using, e.g., the credit balance determined at block 403. In some implementations, the gaming system allows the player to place a minimum wager, a maximum wager, or other suitable wager therebetween. Also, in some implementations, an amount of the wager may determine the value of some of the awards available from the game. In some implementations, the gaming system determines whether the credit balance determined at block 403 includes enough credits to enable the wager received at block 405. The gaming system may prevent the player from placing the wager and initiating play of a game if the credit balance determined at block 407 is not large enough to support the wager. If enough credits are not available in the player's credit balance, the gaming system may provide the player with an option to insert additional value to obtain the minimum credit level or to cash out of the gaming system. A cash out request may trigger the gaming system to issue a cash out request or signal to a value dispenser.

In some implementations, the wager received at block 405 funds one play of a game, whereas a player's credit balance may permit multiple plays of a game for a gaming session. In some implementations, the gaming system starts a play of a game in response to receiving monetary value from a player (e.g., at block 401) and ends when a player cashes out of a gaming system or the player's credit balance is below a minimum wager amount (e.g., zero or other suitable number) and the player does not replenish their credit balance. A gaming session at a gaming system may include zero plays of a game or multiple plays of a game or multiple plays of different games (e.g., where a gaming system includes multiple different games to play).

At block 407, the gaming system updates the credit balance determined at block 403. In some implementations, the credit balance is updated based on the amount of the wager received at block 405. It is understood that some implementations of the method 400 may not include block 407 and that the gaming system may update player's credit balance at other times, such as at the completion of the game.

In some implementations, depending on the amount of the wager received at block 405, the gaming system enables the player to select particular pay lines across reel symbol positions displayed in a game screen (e.g., symbol display areas 510A-510I on reels 502A-502C of game screen 500 in FIGS. 5A-5D). Although in some implementations, the gaming system selects the active pay lines automatically based on the wager received at block 405. It is understood that some implementations of the gaming system may not include pay lines and, as such, the method 400 may not perform any pay line selections. For example, the gaming system may use ways-pays (e.g., all-ways pays) as an alternative to pay lines. It is further understood that some implementations may use "ways-pays" or "ways to win" as an alternative or in combination with the activated pay lines. In some implementations, ways-pays determines wins based on every possible combination in a slot machine game. For example, a five-reel slot machine with three visible symbols display areas can have 243 different pay lines, which can be all possible combinations when evaluating symbols from the left reel to the right reel. In some implementations, ways-pays can be viewed as being independent of pay lines or including all possible pay lines. In some implementations, with ways-pays, a player can win based on any winning combination from left to right. In some implementations, additional ways-pays are available where a gaming system evaluates symbols from left to right or right to left. Ways-pays can alternatively be understood as all the symbols being evaluated as combinations of scatter symbols, where a scatter symbol is a symbol that triggers a payout regardless of whether the symbol appears on a pay line.

At block 411, the gaming system initiates a play of the game. The initiation can be automatically triggered in response to the wager at block 405 or it can be manually triggered in response to receiving an input via an input device. For example, for a game that includes video-based reels, the player may press a spin button on the gaming system (e.g., input device 115) or actuate a lever to start spinning the video-based reels of the gaming system (or randomly generating symbols using other methods) for the play of the game.

It should be appreciated that video-based reels, reels, slot machine reels, gaming reels, etc. used throughout the specification may refer to mechanical reels, electro-mechanical reels, or video reels. It should further be appreciated that although many examples illustrated in the specification describe the gaming system in terms of slot machines with reels, other gaming systems may be used, including gaming systems without reels.

At block 417, the gaming system randomly determines, using a random number generator (e.g., random number generator 207), symbols for a base game from one or more symbol sets. In implementations in which the game reels are rendered using a video display (e.g., display 120), the random number generator can be used to select the symbols from the one or more symbol sets (e.g., sets comprising game symbols 214). As non-limiting examples, the symbol sets can include graphical indicators depicting numbers, letters, geometric figures, playing cards, images, characters, animations, blanks (e.g., the absence of symbols), or the like. Additionally, the symbols sets may include modifier symbols, such as cash award symbols (e.g., 100 credits or $10) and award multiplier symbols (e.g., a 10× increase in an award of a winning combination). Further, the symbol sets may include special or designated symbols (e.g., wild symbols, trigger symbols, scatter symbols, collectable symbols, free game symbols, etc.). In some implementations, types of symbols included in the symbol sets may be different. While the reels above are described as being rendered by a video display, it is understood that some implementations may instead use mechanical or electro-mechanical game reels to select symbols by physically rotating to a randomly-selected stop position.

At block 419, in some implementations, the gaming system causes a display device (e.g., game display device 120) to display the randomly determined symbols determined at block 417. For example, in some implementations in which reels are rendered using a video display, the gaming system may populate visible symbol display areas displayed on one or more reels displayed in the game.

Turning to FIG. 4B, as indicated by off-page connector "A," at block 423, the gaming system evaluates the determined symbols for winning symbols and/or winning symbol combinations, if any. In some implementations, the gaming system evaluates the displayed symbols across (e.g., across active or wagered pay lines and/or based on ways pays) for winning symbols or winning symbol combinations. In some implementations, the gaming system evaluates the winning symbol combinations based on the pay lines wagered upon by a player, ways-pays, scatter symbols, or other suitable evaluation criteria. The gaming system may evaluate the player-selected pay lines, gaming system assigned pay lines, or pay lines assigned as active in some other manner for the play of the game. In some implementations using reels, the gaming system determines an award based on winning symbols or winning symbol combinations displayed across the reels on active pay lines. For example, if a pay table associated with the gaming system indicated that at least three of the same Cherry symbols is a winning symbol combination on an active pay line and results in a predetermined award, the gaming system may evaluate the determined and displayed symbols for groupings of at least three Cherry symbols. If the gaming system determined and displayed at least three Cherry symbols on adjacent reels and along an active pay line, the gaming system may determine that the three Cherry symbols is a winning symbol combination based on the pay table. It should be appreciated that a pay table may include any suitable number of different winning symbols and/or winning symbol combinations and associated awards. In some implementations, a pay table may indicate that as few as one symbol may be associated with an award. Alternatively, any suitable two or more symbols may be used to form winning symbol combinations that result in an award. It should be appreciated that in some implementations, the gaming system may determine winning symbols and/or winning symbol combinations prior to the determined symbols in block 417 being displayed in block 419.

At block 425, the gaming system determines one or more awards based on the winning symbols or winning symbol combinations determined at block 423. In some implementations, the gaming system may also evaluate the displayed symbols for one or more Wild symbols, as shown in block 426. If the gaming system does not find one or more Wild symbols, the gaming system may move to block 427, where the gaming system updates the credit balance determined at block 407 based on the amount of the award or awards determined at block 425. It should be understood that some implementations of the method 400 may not include block 427 and that the gaming system may update player's credit balance at other times, such as at the completion of the game.

At block 431, the gaming system determines whether a bonus game should be triggered. In some implementations, the gaming system triggers the bonus game feature based on, for example, an output from a bonus controller (e.g., bonus server 303). In some implementations, the gaming system randomly triggers the bonus game based on, for example, an output from a random number generator. In some implementations, the gaming system randomly triggers the bonus game after occurrence of a threshold number of events since trigging a previous bonus game (e.g., after wager values in a gaming session exceed a threshold, after a quantity of plays of a game, after a predetermined period of time, etc.). In some of such implementations, the gaming system triggers the bonus game based on determining that the symbols displayed at block 419 include a trigger symbol, a quantity of trigger symbols, a particular sequence of trigger symbols, or some other suitable triggering event. For example, the gaming system may trigger the bonus game if a sequence of three trigger symbols are displayed along an active pay line.

If the gaming system determines that the bonus game has not been triggered (e.g., block 431 is "No"), then the method 400 proceeds to block 433. In some implementations, as indicated in block 433, the gaming system may receive a request or signal to end game play or "cash out" via an input device (e.g., an input device 115) of the gaming system (e.g., which would end the gaming session). In such a situation, the gaming system may dispense a value to the player, through a value dispenser, based on the player's gaming credit balance as illustrated in block 435 and method 400 ends.

If the gaming system has not received a request or signal to end game play (e.g., the player continues the gaming session to play another play of the game), the process of method 400 may return to block 405, as indicated by off-page connector C. The gaming system may receive, via a player input device, a wager for another play of the game and continue method 400 from block 405. However, in some implementations, the wager may not be accepted if the player has fewer credits than the player's selected wager amount. Referring back to block 431, if the gaming system determines the bonus game has been triggered (e.g., block 431 is "Yes,") then the gaming system may move to block 432 and execute the bonus game and provide any awards associated with the bonus game. In some implementations, the gaming system may not include a bonus game.

Returning to block 426, if the gaming system finds one or more Wild symbols (e.g., block 426 is a "Yes"), the gaming system may move to block 437 in FIG. 4C, as indicated by off-page connector "B." As illustrated in block 437, the gaming system may determine whether the displayed one or more Wild symbols (e.g., initially displayed Wild symbols as part of the determined plurality of symbols) were associated with an award. If the initially displayed Wild symbols were associated with an award (e.g., block 437 is "Yes"), the gaming system may return to block 427 in FIG. 4B, as indicated by off-page connector "D." The gaming system may continue with block 427 as discussed above.

Returning to block 437, if the gaming system determines that at least one displayed Wild symbol was not associated with an award (e.g., block 437 is "No"), the gaming system may move to block 439. In some implementations, as shown in block 439, the gaming system may determine one or more additional Wild symbols to display in the symbol display areas. For example, in some implementations, the gaming system may determine one additional Wild symbol to display in a symbol display area of a column of symbol display areas, where the initially displayed Wild symbol was already displayed in one of the symbol display areas of the column. In another example with reels, the gaming system may determine one or more additional Wild symbols to display in visible stop positions of a reel, where the reel included the initially displayed Wild symbol. In some implementations, the gaming system may determine enough additional Wild symbols to display on a reel based on the quantity of non-Wild symbols displayed on the reel. In some implementations, the gaming system may display the determined additional Wild symbols, either by replacing non-Wild symbols in selected symbol display areas or by obscuring the non-Wild symbols on selected symbol display areas with the additional Wild symbols. It should be appreciated that the gaming system may display additional Wild symbols in any suitable symbol display area or in any suitable reel. It should also be appreciated that the gaming system may determine any suitable quantity of additional Wild symbols to display based a variety of different conditions. For example, the gaming system may determine the quantity of additional Wild symbols to display based on the player's wager, where a larger wager may result in a larger quantity of additional Wild symbols to display than a small wager. The gaming system may determine the quantity of additional Wild symbols to display based on a random/pseudo-random event, such selecting a random number from a pool of numbers, where the selected number may dictate the quantity of additional Wild symbols to display. As illustrated in block 440, the gaming system may display the one or more additional Wild symbols determined in block 439 in appropriate symbol display areas.

In some implementations, the gaming system may reevaluate the displayed symbols (e.g., now including the additional Wild symbols) for winning symbols or winning symbol combinations (e.g., skipping to block 445) and provide additional awards to the player based on the determined winning symbols or winning symbol combinations. However, in some implementations, as shown in FIG. 4C, the gaming system may provide the player with additional replacement symbols for more opportunities to win awards.

In some implementations, as shown in block 441, the gaming system may randomly, using a random number generator (e.g., random number generator 207), determine a one or more replacement symbols from the one or more symbol sets (e.g., the symbol sets used in connection with block 417), where the one or more replacement symbols are for symbol display areas that do not include Wild symbols (e.g., the initial Wild symbols and additional Wild symbols). The gaming system may also display the determined replacement symbols in symbol display areas that do not include Wild symbols as shown in block 443. In some implementations, the gaming system replaces the non-Wild symbols with the replacement symbols. The gaming system may replace some but not all non-Wild symbols with replacement symbols in some implementations. The gaming system may replace all non-Wild symbols with replacement symbols in some implementations. It should be appreciated that determining and displaying replacement symbols in blocks 441 and 443 involve similar processes as discussed in connection with blocks 417 and 419 and will not be repeated. It should be appreciated that in some implementations, the gaming system may have provided additional Wild symbols based on a non-winning Wild symbol and replace one or more other non-Wild symbols to provide the player with a second displayed set of symbols.

At block 445, the gaming system determines winning symbols and/or winning symbol combinations of the displayed symbols in the symbol display areas, if any. As noted above, the symbol display areas may be updated to display the additional Wild symbols and replacement symbols as well as the initially displayed Wild symbols. These new symbol combinations may be different than the symbols combinations that were displayed for the evaluation at blocks 417-423 and enables the player to have additional opportunities to win awards. The manner in which the gaming system can determine winning symbols or winning symbol combinations was discussed above in block 423 and is not repeated again. At block 447, the gaming system determines one or more awards based on the winning symbols or winning symbol combinations determined at block 445.

The gaming system may return to block 427 and execute the subsequent blocks as discussed above.

Based on the foregoing, it should be appreciated that by increasing a quantity of a predetermined symbol (such as a Wild symbol), the gaming system and method provides additional opportunities for a player to obtain winning symbol combinations and provide a player with new ways to obtain awards.

While FIGS. 4B and 4C were discussed in terms of Wild symbols, other suitable symbols can be used in place of Wild symbols. That is, the gaming system can designate any suitable symbol from the symbol sets as a predetermined symbol that causes the gaming system to perform the actions discussed herein in connection with the Wild symbol. In some implementations, the predetermined symbol can be designated before or during a play of a game. Moreover, the gaming system may designate more than one such predetermined symbol for a play of a game. It should be appreciated that using different symbols for the predetermined symbol can lead to outcomes that are different and novel from outcomes using only a Wild symbol.

FIGS. 5A-5D show example images of a game screen 500 displayed by a gaming system (e.g., gaming system 100) in accordance with aspects of the present disclosure. More specifically, FIGS. 5A-5D illustrate example screen shots the game screen 500 that may be displayed by a display device (e.g., display device 120) in one implementation of the gaming system. As detailed previously herein, implementations consistent with the present disclosure can provide a game including a first part of a game (e.g., a base game) and a second part of a game (e.g., a bonus game). In some implementations, game screen 500 may be displayed on first display device 120 of gaming system 100 illustrated in FIG. 1. However, any other suitable display devices may be used.

Figure 5A:
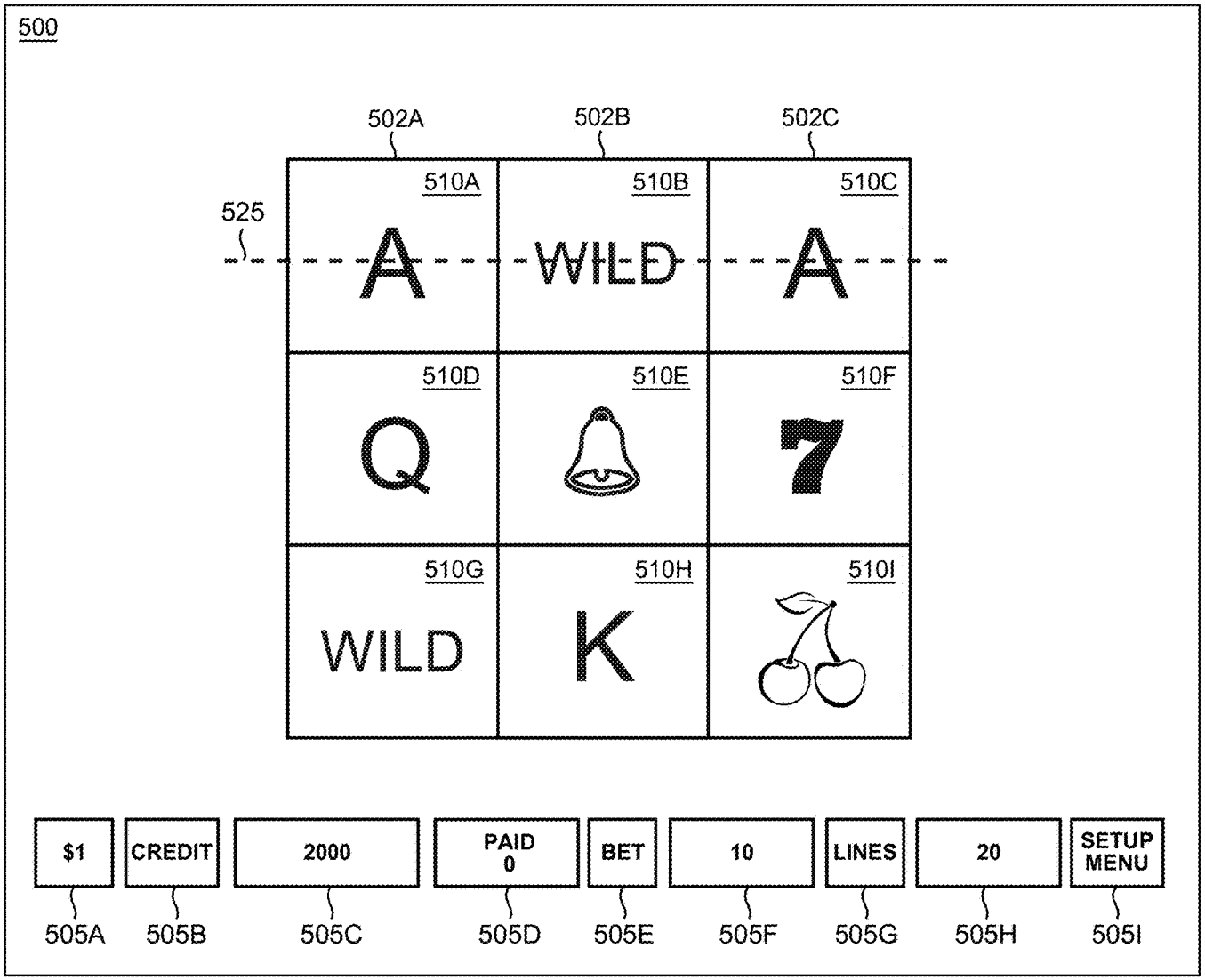
FIGS. 5A, 5B, 5C, and 5D show a picture of a game screen displayed by a gaming system in accordance with aspects of the present disclosure.

The game screen 500 shows a set of a reels 502A, 502B, and 502C as illustrated in FIG. 5A for a base game. As also illustrated in FIG. 5A, the reels 502A-502C are shown substantially side by side. It should be appreciated that reels 502A-502C can be shown with any suitable amount of separation or no separation. It should be appreciated that the game shown in game screen 500 is merely representative and may have more or fewer game elements (e.g., reels, symbol display areas, symbols, etc.) shown in the game screen 500. It should also be appreciated that other games may be used for the primary or base game. It should further be appreciated that game screen 500 and associated symbol display areas may be independent of or not associated with video reels. In some implementations, some base games may lack reels.

In some implementations, the reels 502A-502C are each respectively associated with a set of symbols or a symbol set, where each symbol set includes a quantity of symbols. The symbol sets can be associated with the same or different symbols. The sets of symbols may include numbers, letters, geometric figures, symbols, images, characters, blank symbols (e.g., the absence of symbols), animations, transparent symbols (e.g., symbols that permits underlying symbols to be visible), or any other suitable graphical depiction. The symbols in the symbol sets may include pay symbols, special or designated symbols (e.g., Wild symbols), or other suitable types of symbols.

In FIG. 5A, the game screen 500 depicts a plurality of symbol display areas (a.k.a., symbol display positions) 510A, 510B, 510C, 510D, 510E, 510F, 510G, 510H, and 510I. The plurality of symbol display areas can be associated in a manner that provides the appearance of game or slot machine reels. It should also be appreciated that the symbol display areas may not be associated with game reels in some implementations. As illustrated in FIG. 5A, symbol display areas 510A, 510B, 510C, 510D, 510E, 510F, 510G, 510H, and 510I are associated in a manner that provides the appearance of a set of three slot machine game reels. In some implementations, the plurality of symbol display areas that provide the appearance of three game reels may be arranged in a manner that visibly shows three symbol display positions (e.g., symbol display areas or visible reel stop position) of each of the three game reels. For example, the symbol display areas 510A-510I are each associated with positions on reels 502A-502C, respectively. As shown in FIGS. 5A-5D, symbol display areas 510A, 510D, and 510G are associated with reel 502A; symbol display areas 510B, 510E, and 510H are associated with reel 502B; and symbol display areas 510C, 510F, and 510I are associated with reel 502C. The gaming system may display fewer or more reels in various implementations.

Figure 5B:
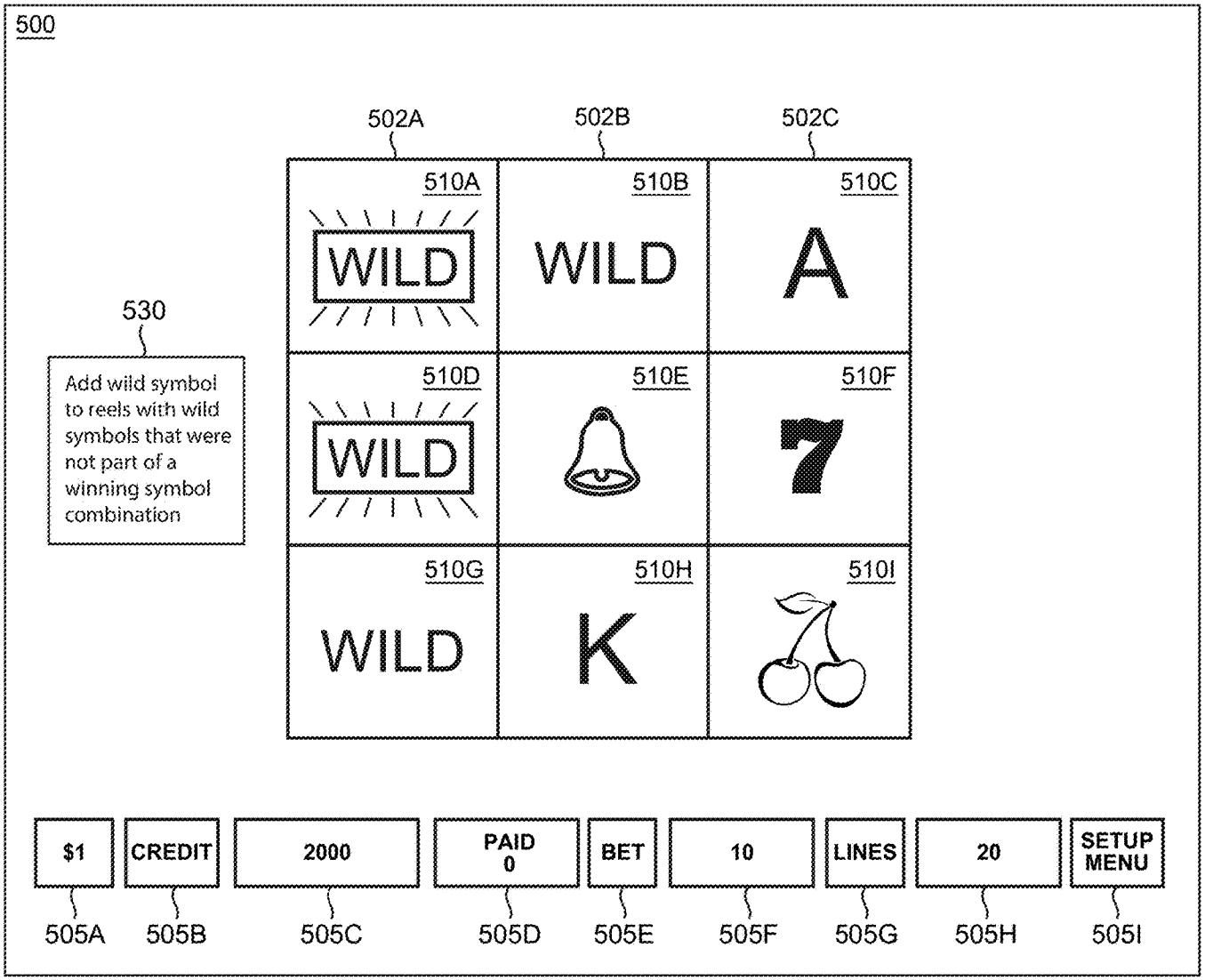

The arrangement illustrated in the implementation of FIGS. 5A and 5B thus creates a visible display area of the reels 502A-502C having three visible symbol positions for each reel. When viewed together, reels 502A-502C appear as a 3-row by 3-column reel array in game screen 500. In other implementations, smaller or larger visible areas of the reels may be displayed. That is, the reels 502A-502C may show fewer or a larger number of visible symbol display areas. In some implementations, some symbol display areas can be hidden to hold generated symbols for use when the reels are nudged. In some implementations, the visible symbol display areas for the reels represent visible reels stop positions of reel strips associated with the reels. While symbol display areas are illustrated with defined boxes or borders, it should be appreciated that in some implementations, game screen 500 may not use defined borders or make borders visible. In some implementations with reels, the gaming system may display reel borders, but not borders between symbol display areas. In some implementations without reels, the gaming system does not display reel borders. It should also be appreciated that in some implementations, the symbol display areas are other shapes or not defined shapes and may not be associated with game elements or objects other than reels.

Reels 502A-502C may display a plurality of symbols that the gaming system generates from the symbol sets in their respective symbol display areas, as illustrated in FIG. 5A. In some implementations, the individual reels may be shown spinning in one direction to simulate slot machine reels. However, it should be appreciated that the reels may be shown spinning in any suitable direction. The reels may also be shown spinning in different directions in some implementations. In some implementations, the gaming system does not depict spinning reels or spinning symbols.

Game screen 500 also includes several information areas and buttons 505A-505I. These information areas and buttons 505A-505I are illustrated in an example configuration and positioning associated with a particular arrangement, but may be arranged in any suitable manner in different implementations. In some implementations, game screen 500 may include more or fewer display areas and buttons 505A-505I than illustrated. In some implementations, game screen 500 may not show any information areas or buttons. Information area 505A illustrates an example value of one credit for the game displayed in game screen 500, and in the example shown in FIGS. 5A-5D, information area 505A illustrates a value of $0.01. Button 505B illustrates a software button that the player can select to view how many credits the player has accumulated and monetary value of these credits if the player wishes to cease playing (e.g., a product of a value per credit shown in information area 505A and a quantity of remaining credits shown in information area 505C). Information areas 505C illustrate an example of the amount of the player's available credits. In the example shown in FIGS. 5A-5D, information area 505C illustrates that the player has 2000 available credits after placing a wager. Information area 505D illustrates the amount of credits a player has won. Because FIG. 5A illustrates an example display associated with a start of a play of a game, the information area 505D shows zero credits have been won during the play of the game.

Button 505E illustrates a software button that the player can select to place a bet or wager. It should be appreciated that the functionality of button 505E may also be replicated or replaced with a hardware button on the gaming system 100. Information area 505F illustrates that the player has selected to wager 10 credits per pay line. Button 505G illustrates a software button that the player can select to determine how many pay lines to wager on. It should be appreciated that the functionality of button 505G may also be replicated or replaced with a hardware button on the gaming system 100. Information area 505H identifies a quantity of pay lines on which the player chooses to wager, and in the example shown in FIG. 5A, information area 505H indicates that the player selected to wager on 20 pay lines. It should be appreciated that in some implementations, the player does not select a quantity of pay lines. Button 505I illustrates a software button that the player can select to obtain information about the game, change certain aspects of the game, obtain help, place an order, etc. It should be appreciated that some figures discussed in the present disclosure may not show information areas and buttons 505A-505I for ease of explanation.

To start a gaming session, a player may provide the gaming system with a deposit of value, using one of the suitable mechanisms discussed above. The gaming system receives and validates the player's deposit of value. The gaming system can then issue credits (or gaming credits) to the player based on the received value. The credits enable the player to initiate a play of a game for the gaming session and to also place wagers on the play of the game. The gaming system may provide a visual indication of the player's credit balance to the player as discussed above in information area 505C.

To initiate the play of the game, the may player select a wager, using a suitable input device (e.g., a button, lever, motion detector, etc.) on the gaming system, to deduct credits necessary to play the game and to identify the player's wager. Along with receiving the player's wager, the gaming system may receive pay line selections or other game functions the player wishes to activate in exchange for the wager. The player may also actuate a game start button, a spin button, a lever (not shown), or some other suitable input device. The gaming system may deduct the appropriate credits from the player's credit balance (e.g., in information area 505C) after the wager or at any suitable time. For example, the gaming system may deduct a wager per pay line in information area 505F multiplied by a number of pay lines in information area 505H.

Upon receipt of the player's wager and activation of a play of the game, the gaming system may show a display of spinning reels for the reels 502A-502C (not shown). The spinning may appear to occur in a vertical top to bottom direction or in a vertical bottom to top direction (not shown), or in a combination of vertical directions (not shown). In some implementations, the gaming system randomly determines symbols from the associated symbol sets for reels 502A-502C, respectively. As noted above, the gaming system may rely on random generation performed by a pseudo RNG, a true RNG, or hardware RNG specifically designed for gaming systems. In some implementations, the gaming system may also update the player's credit meter (information area 505C) to reflect the player's available credit balance. As shown in FIG. 5A, the player's credit meter (information area 505C) was decremented by 200 credits from 2200 to 2000 to reflect a prior 200 credit wager the player placed for the play of the game.

The gaming system may display the determined symbols in symbol display areas 510A-510I, as illustrated in FIG. 5A. Symbols displayed on reels 502A-502C illustrate the randomly generated symbols from the symbol sets after the reels have stopped spinning. As illustrated in FIG. 5A, the gaming system randomly determined and displayed symbols in symbol display areas 510A-510I for reels 502A-502C.

In the example illustrated in FIG. 5A, the gaming system generated and displayed an Ace symbol ("A") in symbol display areas 510A and 510C; Wild symbols in symbol display areas 510B and 510G; a Queen symbol ("Q") in symbol display area 510D; a Bell symbol in symbol display area 510E; a Seven symbol in symbol display area 510F; a King symbol ("K") in symbol display area 510H; and a Cherry symbol in symbol display area 510I. It should be appreciated that the displayed symbol combinations are randomly determined and merely for explanatory purposes and the gaming system may randomly determine or generate any suitable combination of symbols based on defined symbol sets associated with the reels 502A-502C.

In some implementations, the gaming system may evaluate the displayed symbols on reels 502A-502C for winning symbols or winning symbol combinations. As noted above, the player may have wagered on one or more pay lines (e.g., such as 20 pay lines shown in information area 505H). In some implementations, at least the active (e.g., the wagered on pay lines) are evaluated for winning symbol combinations. Any suitable number of pay lines may be used to evaluate winning symbol combinations. The gaming system may use other suitable methods of evaluating the displayed symbols for winning symbols or winning symbol combinations (e.g., ways pays, scatter combinations, etc.).

In some implementations, the gaming system may evaluate the generated symbols on reels 502A-502C for triggering symbols or combinations of symbols that trigger features for the play of the game (hereafter referred to as "triggering symbol combinations"). As noted above, the player may have wagered on one or more pay lines (such as 20 pay lines shown in information area 505H). In some implementations, at least the active (e.g., the wagered on pay lines) are evaluated for triggering symbol combinations. Any suitable number of pay lines may be used to evaluate for the triggering symbol combinations. In some implementations, the gaming system evaluates the displayed symbols for winning symbols and/or winning symbol combinations before evaluating the displayed symbols for triggering symbol combinations. In some implementations, the gaming system evaluates the displayed symbols for triggering symbol combinations before evaluating the displayed symbols for winning symbols and/or winning symbol combinations.

In the example shown in FIG. 5A, the gaming system evaluates the displayed symbols for winning symbol combinations and/or triggering symbol combinations along active pay lines. In FIG. 5A, the gaming system may determine that reels with a winning symbol combination was displayed based on the Ace, Wild, and Ace symbols appearing on certain wagered pay lines. For example, pay line 525 was an active pay line, and the Ace, Wild, Ace symbols combination were present along the pay line 525 in symbol display areas 510A, 510B, and 510C. As noted above, in some implementations, the gaming system treats a Wild symbol as a symbol that can mimic adjacent symbols. In the implementation shown in FIG. 5A, the gaming system treats the Wild symbol as an Ace symbol based on the adjacent Ace symbol in symbol display area 510A. Thus, the gaming system evaluates the Ace, Wild, Ace symbols in 510A, 510B, and 510C as symbol combination of Ace, Ace, Ace. In some implementations, the gaming system compares the Ace, Ace, Ace symbol combination against a pay table (not shown). In some implementations, if the Ace, Ace, Ace symbol combination is in the pay table and associated with an award, the gaming system determines that the Ace, Wild, Ace symbols in 510A, 510B, and 510C along pay line 525 is a winning symbol combination.

As also illustrated in FIG. 5A, the gaming system may determine an award for the play of the game based on the displayed winning symbol combinations of Ace symbols and an associated pay table (not shown). The gaming system may update the player's gaming credit balance (not shown) in accordance with the calculated value of the award for the winning combination of Ace symbols. In some implementations, the gaming system updates the player's gaming credit balance at a later time.

In some implementations, the gaming system may also evaluate the displayed symbols for one or more Wild symbols. In some implementations, if the gaming system determines that Wild symbols were not displayed, the gaming system may determine if a bonus game is triggered, update the player's gaming credit balance, and/or terminate the play of the game as is discussed below.

On the other hand, where the gaming system finds one or more Wild symbols such as a Wild symbol in symbol display area 510B and a Wild symbol in symbol display area 510G, the gaming system determines whether a predetermined game event has occurred. In some implementations, the predetermined game event includes the gaming system determining whether the displayed one or more Wild symbols (e.g., initially displayed Wild symbols as part of the determined plurality of symbols) were associated with an award. As is shown in FIG. 5A, the Wild symbol in symbol display area 510B is associated with an award because it formed part of the winning symbol combination of Ace, Wild, Ace along pay line 525. However, the Wild symbol in symbol display area 510G did not form part of a winning symbol combination. Thus, the gaming system determined that at least one Wild symbol was displayed and did not result in an award. In some implementations, the gaming system can be configured such that more than one Wild symbol must be displayed and not result in an award to meet the predetermined game event. In other implementations, the predetermined event can be other suitable events. It should also be appreciated that if both Wild symbols were associated with awards, the gaming system may determine if a bonus game is triggered, update the player's gaming credit balance, and/or terminate the play of the game as is discussed below without executing the features discussed in connection with FIGS. 5B-5D.

Turning to FIG. 5B, if the gaming system determines that at least one displayed Wild symbol was not associated with an award, the gaming system may provide the player with additional features to potentially help the player obtain additional awards for the play of the game. In some implementations, as shown in FIG. 5B, the gaming system may determine one or more additional Wild symbols to display in the symbol display areas. As shown in the information area 530, the gaming system alerts the player that the gaming system will add additional Wild symbols to reels that have Wild symbols that were not part of a winning symbol combination. As shown in FIG. 5B, the gaming system added additional Wild symbols to symbol display areas 510A and 510D. In some implementations, the gaming system may highlight the newly added Wild symbols in a suitable manner. In some implementations, the gaming system can add fewer Wild symbols, or where a reel included more visible symbol display areas, the gaming system could have added more Wild symbols. In some implementations, the gaming system adds additional Wild symbols to reels that included the initially displayed Wild symbols that were not part of a winning symbol combination. As can be seen in FIG. 5B, the gaming system did not add additional Wild symbols to reel 502B because the Wild symbol in 510B was part of a winning symbol combination. However, it should be appreciated the gaming system can add additional Wild symbols to other reels with Wild symbols regardless of whether the other Wild symbols were part of a winning symbol combination (e.g., where one Wild symbol meets the condition, then all Wild symbols receive the benefit of additional Wild symbols). In some implementations, the gaming system may add additional Wild symbols to reels without Wild symbols. The gaming system may randomly select reels or symbol display areas that will display additional Wild symbols in some implementations.

In some implementations, the gaming system can add additional Wild symbols vertically on a reel that includes an initially displayed Wild symbol. In some implementations, the gaming system can add additional Wild symbols horizontally across multiple reels, where one of the reels that includes an initially displayed Wild symbol. In some implementations, the gaming system can add additional Wild symbols diagonally across multiple reels, where one of the reels includes an initially displayed Wild symbol.

In some implementations, the gaming system may display the determined additional Wild symbols, either by replacing non-Wild symbols in selected symbol display areas or by obscuring the non-Wild symbols on selected symbol display areas with the additional Wild symbols. It should be appreciated that the gaming system may display additional Wild symbols in any suitable symbol display area or in any suitable reel. It should also be appreciated that the gaming system may determine any suitable quantity of additional Wild symbols to display based a variety of different conditions. For example, the gaming system may determine the quantity of additional Wild symbols to display based on the player's wager, where larger wagers may result in larger quantities of additional Wild symbols to display than small wagers. The gaming system may determine the quantity of additional Wild symbols to display based on a random/pseudo-random event, such selecting a random number from a pool of numbers, where the selected number may dictate the quantity of additional Wild symbols to display. In some implementations, the gaming system may reevaluate the displayed symbols again after the gaming system adds the additional Wild symbols to determine any new or additional winning symbol combinations that result in an award.

Figure 5C:
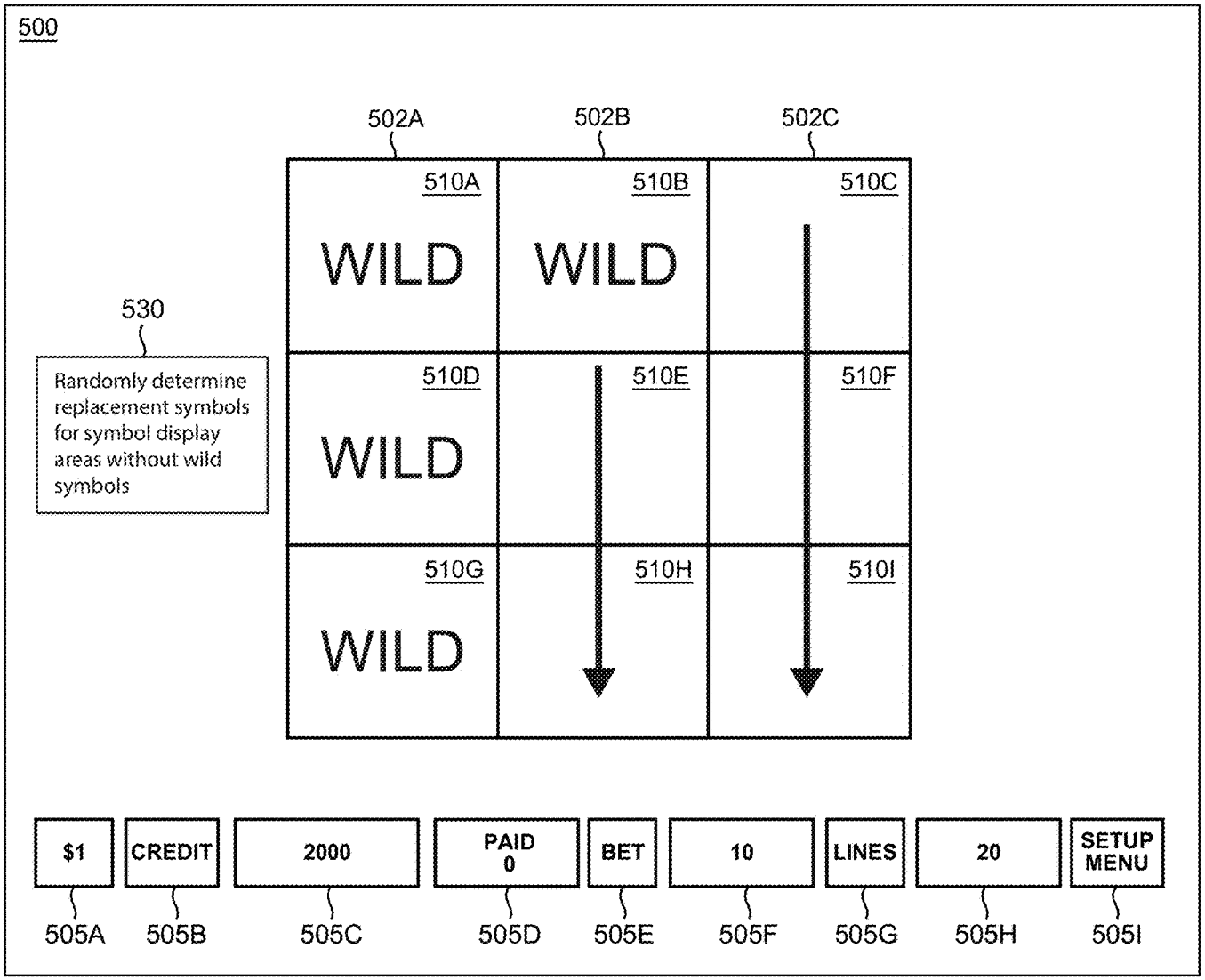

In some implementations, as shown in FIG. 5C, the gaming system may keep the displayed Wild symbols and provide the player with additional replacement symbols for more opportunities to win awards. As shown in information area 530 of FIG. 5C, the gaming system alerts the player that it is randomly determining replacement symbols for symbol display areas that do not display Wild symbols. In some implementations, the gaming system may replace all of the non-Wild symbols with replacement symbols. In other implementations, the gaming system may replace fewer than all of the non-Wild symbols, or one or more non-Wild symbols. In some implementations, the gaming system may also replace the Wild symbols that were part of a winning symbol combination. For example, in some implementations, the gaming system may replace the Wild symbol in symbol display area 510B because it was part of a winning symbol combinations. However, in the illustrated implementation, the Wild symbol in symbol display area 510B is not replaced during the play of the game.

To obtain replacement symbols, in some implementations, the gaming system may randomly, using a random number generator (e.g., random number generator 207), determine a plurality of replacement symbols from the one or more symbol sets used to determine the initially displayed symbols in FIG. 5A. As noted above, in the illustrated implementation, the plurality of replacement symbols are for symbol display areas that do not include Wild symbols (e.g., the initial Wild symbols and additional Wild symbols).

Figure 5D:
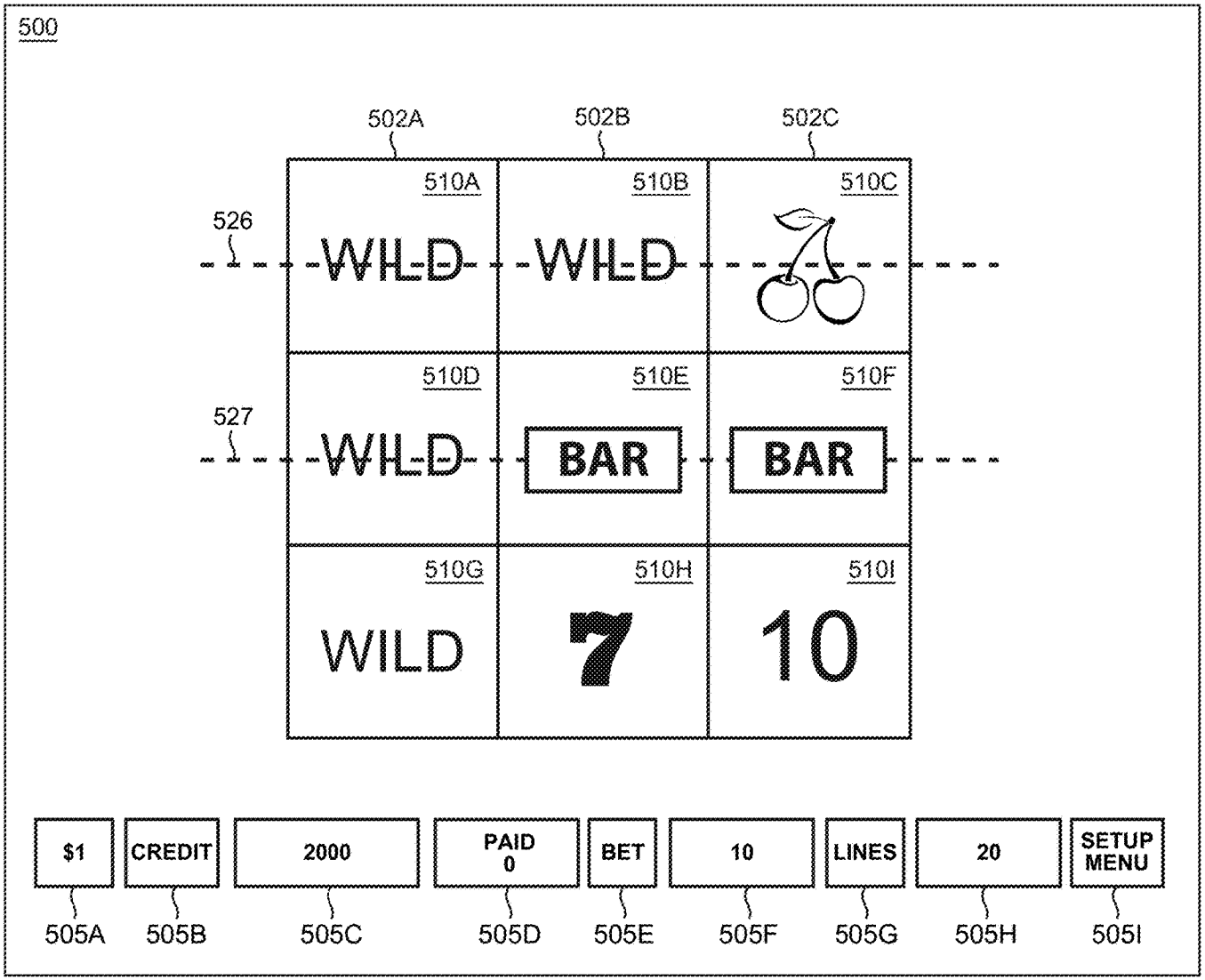

Turning to FIG. 5D, the gaming system displays the determined replacement symbols in symbol display areas that do not include Wild symbols (e.g., symbol display areas 510C, 510E, 510F, 510H, and 510I). As shown in FIG. 5D, the gaming system may determine winning symbols and/or winning symbol combinations of the newly displayed symbols in the symbol display areas of reels 502A-502C, if any. In this instance, the gaming system determined that new winning symbol combinations of Wild, Wild, Cherry in symbol display areas 510A, 510B, and 510C was formed along pay line 525. This winning symbol combination evaluated as three Cherry symbols and provided an award according to an associated pay table. Likewise, the gaming system determined that another new winning symbol combination of Wild, Bar, Bar in symbol display areas 510D, 510E, and 510F was formed along pay line 527. This winning symbol combination evaluated as three Bar symbols and provided an award according to an associated pay table. Other winning symbol combinations possibilities were not shown. With the additional awards, the gaming system may update the player credit balance in some implementations.

The gaming system may also determine whether a bonus game is triggered in some implementations (not shown). If a bonus game is triggered, the gaming system may execute the bonus game. If the gaming system does not trigger a bonus game or after the bonus game is completed, the player may continue the gaming session (e.g., play another consecutive play of the game) by executing another play of the game (e.g., part of a gaming session). That is, the player may place another wager and start a new play of the game as noted above. However, continued game play is dependent on the number of credits remaining in the player's credit balance. The player may choose to cash out. The player may select an input button associated with a cash out request, where the processor of the gaming system may receive a cash out signal or request. In such an instance, the gaming system can provide the player a value based on the player's credit balance using any of the value items discussed above (bills, coins, vouchers, etc.).

It should therefore be appreciated that providing additional Wild symbols and/or replacing some of the displayed symbols enables the player to have additional opportunities to win awards that were not previously available.

In some alternative implementations, the gaming system may hold the initially displayed and/or additionally added Wild symbols for one or more plays of the game. In some implementations, the gaming system may hold the Wild symbols for a next play of the game where the player provides an additional wager at the start of the play of the game or provides a wager that meets or exceeds a threshold wager value. In some implementations, the gaming system offers the player an option to place an additional wager at the end of game so that the displayed Wild symbols (e.g., Wild symbols shown in symbol display areas 510A, 510B, 510D, and 510G of FIG. 5D) are held for one or more additional plays of the game. In some implementations, the Wild symbols are not held between different plays of the game.

In some implementations, as noted above, the gaming system may use different symbols in place of Wild symbols. For example, if a King symbol in symbol display area 510H of FIG. 5A was the predetermined symbol, the gaming system may have added one or more additional King symbols on reel 502B, similar to how the gaming system added additional Wild symbols in FIG. 5B.

In some implementations, the gaming system may designate more than one symbol as the predetermined symbol for a play of a game. For example, in some implementations, the gaming system may designate Wild symbols and King symbols as predetermined symbols. Thus, where the gaming system displayed Wild symbols and King symbols, the gaming system may add additional symbols of both Wild symbols and King symbols to the symbol display areas. In some implementations, different predetermined symbols can be associated with different properties. For example, in some implementations, the Wild symbol may cause the gaming system to add additional Wild symbols vertically along one reel whereas the King symbol may cause the gaming system to add additional King symbols horizontally along multiple reels.

In some implementations, some symbols can be designated as more valuable than the additional predetermined symbols. For example, a scatter symbol can be designated more valuable than the predetermined symbol (e.g. a Wild symbol). In some such implementations, if a scatter symbol was displayed in a symbol display area, the gaming system does not overwrite or obscure the scatter symbol with additional Wild symbols. Returning to the example where Wild symbols and King symbols are predetermined symbols, one of such symbols can be designated to overwrite the other where gaming system would have added an additional King symbol and Wild symbol to the same symbol display area. In some implementations, a more valuable predetermined symbol can overwrite a less valuable predetermined symbol. In some implementations, a less valuable predetermined symbol can overwrite a more valuable predetermined symbol.

The gaming system also provides unique technical advantages in a practical application. In some implementations, the features described herein technologically improves the gaming system by reducing the quantity of symbols that are generated and displayed during a play of a game. For example, when the gaming system holds Wild symbols, as shown in FIG. 5C, the gaming system may generate and display fewer replacement symbols over the course of a play of a game. By minimizing the quantity of replacement symbols to generate and display, the gaming system reduces the quantity of symbols to generate, enabling the gaming systems to complete a play of a game more quickly than systems that evaluate all of the displayed symbols. By doing so, in some implementations, the disclosed gaming systems can increase the usage rate of the gaming system by allowing more games to be completed in a given time period (e.g., games per hour) and by reducing power consumed during one or more plays of a game.

Moreover, in some implementations, reducing the quantity of symbols to generate and display also reduces the processing load and memory consumption of the gaming system. By doing so, implementations of the disclosed gaming system avoid reading and writing certain symbols from memory, which increases the efficiency of the gaming system by conserving processor loading and reduces memory consumption. And, when such efficiency improvements are made and applied to the hundreds or thousands of game evaluations in multiple installations of the gaming system (e.g., multiple devices installed at a casino), implementations of the disclosed gaming system provide casino game operators sizable gains in machine efficiency, which is a technological improvement in a practical application.

The present disclosure is not to be limited in terms of the particular implementations described in this application, which are intended as illustrations of various aspects. Moreover, the various disclosed implementations can be interchangeably used with each other, unless otherwise noted. Many modifications and variations can be made without departing from its spirit and scope, as will be apparent to those skilled in the art. Functionally equivalent methods and apparatuses within the scope of the disclosure, in addition to those enumerated herein will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is also to be understood that the terminology used herein is for the purpose of describing particular implementations only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." In addition, where features or aspects of the disclosure are described in terms of Markush groups, those skilled in the art will recognize that the disclosure is also thereby described in terms of any individual member or subgroup of members of the Markush group.

A number of implementations of the invention have been described. Various modifications may be made without departing from the spirit and scope of the invention. For example, various forms of the flows shown above may be used, with steps re-ordered, added, or removed. Accordingly, other implementations are within the scope of the following claims.

We claim:

1. A gaming system comprising:

a display device, an input device, a value acceptor, a value dispenser, a random number generator, a memory device, and a processor, wherein the memory device stores program instructions that, when executed by the processor, cause the gaming system to:

establish a credit balance based on a value received by the value acceptor;

receive, via the input device, a wager for a play of a game using the credit balance;

determine, with the random number generator, a plurality of symbols to display in a plurality of symbol display areas;

display, on the display device, the plurality of symbols in the plurality of symbol display areas;

determine that the plurality of symbols includes a predetermined symbol and that the predetermined symbol does not result in an award;

determine one or more additional predetermined symbols for display;

display, on the display device, the one or more additional predetermined symbols, wherein the displayed additional predetermined symbols replaces at least some of the displayed plurality of symbols;

evaluate for one or more winning symbol combinations based on the additional predetermined symbols;

determine one or more awards corresponding to the one or more winning symbol combinations; and issue a second value from the value dispenser based on the one or more awards upon receipt of a cash out request.

2. The gaming system of claim 1, wherein the predetermined symbol is a wild symbol.

3. The gaming system of claim 1, wherein the predetermined symbol is randomly selected from one or more symbol sets used to determine the plurality of symbols.

4. The gaming system of claim 1, wherein the one or more additional predetermined symbols further comprises determining a quantity of predetermined symbols based on a value of the wager.

5. The gaming system of claim 1, wherein the one or more additional predetermined symbols further comprises determining a quantity of predetermined symbols based on a quantity of symbol display areas that are in a column of symbol display areas that displays the predetermined symbol.

6. The gaming system of claim 1, wherein the predetermined symbol is displayed on a reel and the one or more additional predetermined symbols further comprises determining one additional predetermined symbol for each symbol display area of the reel.

7. The gaming system of claim 1, wherein the processor further causes the gaming system to determine, with the random number generator, a plurality of replacement symbols for the plurality of symbol display areas that do not include the predetermined symbol or the one or more additional predetermined symbols.

8. The gaming system of claim 7, wherein the determining of one or more winning symbol combinations further comprises determining one or more winning symbol combinations based on the additional predetermined symbols and the plurality of replacement symbols.

9. The gaming system of claim 1, wherein the processor further causes the gaming system to determine one or more winning symbol combinations based on the determined plurality of symbols.

10. A method of operating a gaming system comprising:

establishing a credit balance based on a first value received by a value acceptor;

receiving, from a player input device, a wager for a play of a game using the credit balance;

determining, with a random number generator, a plurality of symbols for a plurality of symbol display areas;

displaying, on a display device, the plurality of symbols in the plurality of symbol display areas;

determining that the plurality of symbols includes a predetermined symbol and that the predetermined symbol does not result in an award;

determining one or more additional predetermined symbols;

displaying, on the display device, the one or more additional predetermined symbols, wherein the displayed one or more additional predetermined symbols replaces at least some of the displayed plurality of symbols;

determining one or more winning symbol combinations based on the additional predetermined symbols;

evaluating for one or more awards corresponding to the one or more winning symbol combinations; and issuing a second value from a value dispenser based on the one or more awards upon receipt of a cash out request.

11. The method of claim 10, wherein the predetermined symbol is a wild symbol.

12. The method of claim 10, wherein the predetermined symbol is randomly selected from one or more symbol sets used to determine the plurality of symbols.

13. The method of claim 10, wherein the one or more additional predetermined symbols further comprises determining a quantity of predetermined symbols based on a value of the wager.

14. The method claim 10, wherein the one or more additional predetermined symbols further comprises determining a quantity of predetermined symbols based on a quantity of symbol display areas that are in a column of symbol display areas that displays the predetermined symbol.

15. The method of claim 10, wherein the predetermined symbol is displayed on a reel and the one or more additional predetermined symbols further comprises determining one additional predetermined symbol for each symbol display area of the reel.

16. The method of claim 10, further comprising determining, with the random number generator, a plurality of replacement symbols for the plurality of symbol display areas that do not include the predetermined symbol or the one or more additional predetermined symbols.

17. The method of claim 16, wherein the determining of one or more winning symbol combinations further comprises determining one or more winning symbol combinations based on the additional predetermined symbols and the plurality of replacement symbols.

18. The method of claim 10, further comprising determining one or more winning symbol combinations based on the determined plurality of symbols.

19. A non-transitory computer-readable storage device having program instructions stored therein, the program instructions being executable by a processor to cause a gaming system to:

establish a credit balance based on a first value received by a value acceptor;

receive, from a player input device, a wager for a play of a game using the credit balance;

determine, with a random number generator, a plurality of symbols for a plurality of symbol display areas;

display, on a display device, the plurality of symbols in the plurality of symbol display areas;

determine that the plurality of symbols includes a predetermined symbol and that the predetermined symbol does not result in an award;

determine one or more additional predetermined symbols;

display, on the display device, the one or more additional predetermined symbols, wherein the displayed additional predetermined symbols replaces at least some of the displayed plurality of symbols;

evaluate for one or more winning symbol combinations based on the additional predetermined symbols;

determine one or more awards corresponding to the one or more winning symbol combinations; and issue a second value from a value dispenser based on the one or more awards upon receipt of a cash out request.

20. The non-transitory computer-readable storage device of claim 19, wherein the predetermined symbol is a wild symbol.

* * * * *